US009646594B1

(12) United States Patent
Micek

(10) Patent No.: US 9,646,594 B1
(45) Date of Patent: May 9, 2017

(54) TONE CONTROL SYSTEM FOR STRING INSTRUMENTS

(71) Applicant: Petr Micek, Baltimore, MD (US)

(72) Inventor: Petr Micek, Baltimore, MD (US)

( * ) Notice: Subject to any disclaimer, the term of this patent is extended or adjusted under 35 U.S.C. 154(b) by 0 days.

(21) Appl. No.: 15/086,422

(22) Filed: Mar. 31, 2016

(51) Int. Cl.
*G10H 3/00* (2006.01)
*G10H 3/18* (2006.01)
*G10H 1/12* (2006.01)

(52) U.S. Cl.
CPC ..... *G10H 3/186* (2013.01); *G10H 1/12* (2013.01)

(58) Field of Classification Search
CPC G10H 3/18; G10H 1/46; G10H 1/348; G10H 3/186; G10H 3/182; G10H 3/181; G10H 1/045; G10H 1/0535; G10H 1/00; G10H 1/06; G10H 1/34; G10H 1/18; G10H 2220/525; G10H 3/10; G10H 5/06; H04Q 9/12; G10G 7/02; G01H 3/00
See application file for complete search history.

(56) References Cited

U.S. PATENT DOCUMENTS

| | | | | |
|---|---|---|---|---|
| 2,093,245 | A | 9/1937 | Van Loon | |
| 2,322,558 | A | 6/1943 | Bachman | |
| 2,802,063 | A | 8/1957 | Fine et al. | |
| 2,900,609 | A | 8/1959 | Estkowski | |
| 3,147,447 | A | 9/1964 | Fender | |
| 3,421,117 | A | 1/1969 | Grout | |
| 3,449,681 | A | 6/1969 | Hafler | |
| 3,472,943 | A | 10/1969 | Kawabata et al. | |
| 4,151,477 | A | 4/1979 | Yokoyama | |
| 4,164,163 | A | 8/1979 | Rhodes | |
| 4,438,414 | A | 3/1984 | Blachot | |
| 5,124,668 | A | 6/1992 | Christian | |
| 5,136,918 | A * | 8/1992 | Riboloff | G10H 3/18 84/723 |
| 5,509,080 | A | 4/1996 | Roberts | |
| 5,932,827 | A * | 8/1999 | Osborne | G10H 3/18 84/726 |
| 5,977,474 | A | 11/1999 | O'Brien | |
| 6,034,316 | A * | 3/2000 | Hoover | G10H 3/186 84/738 |
| 6,791,023 | B2 | 9/2004 | Nakaya | |
| 8,766,082 | B2 | 7/2014 | Smith | |

(Continued)

OTHER PUBLICATIONS

Dirk Wacker, The Fender TBX Tone Control, Part 1, Sep. 21, 2010, internet web address: http://www.premierguitar.com/articles/the_fender_tbx_tone_control_part_1.

(Continued)

*Primary Examiner* — Marlon Fletcher
(74) *Attorney, Agent, or Firm* — Rosenberg, Klein & Lee

(57) ABSTRACT

A tone control system for string instruments includes at least one capacitive filter selected for coupling to at least one of a pair of series coupled pickup transducer sensors. The tone control system employs a potentiometer or switch to selectively enable the capacitive filter in different filtering configurations. When selectively not enabled, the capacitive filter is connected to neither of the pair of pickup transducer sensors. The capacitive filter may include a pair of filter capacitors for individually being selectively enabled as a low pass filter for one of the pair of pickup transducer sensors and a high frequency bypass circuit path for the other of the pair of pickup transducer sensors.

18 Claims, 17 Drawing Sheets

(56) References Cited

U.S. PATENT DOCUMENTS

| | | | | |
|---|---|---|---|---|
| 8,940,993 | B1 * | 1/2015 | Micek | G10H 3/186 84/725 |
| 9,153,218 | B1 * | 10/2015 | Micek | G10H 3/186 |
| 9,286,874 | B1 * | 3/2016 | Micek | G10H 3/18 |
| 2003/0179893 | A1 | 9/2003 | Smith | |
| 2011/0290099 | A1 * | 12/2011 | Franklin | G10H 3/182 84/733 |
| 2013/0233159 | A1 | 9/2013 | Kuroki | |
| 2015/0107444 | A1 * | 4/2015 | Pezeshkian | G10H 1/34 84/645 |
| 2016/0027422 | A1 * | 1/2016 | Baker | G10H 3/22 84/726 |

OTHER PUBLICATIONS

Dirk Wacker, The Fender TBX Tone Control, Part 2, Oct. 20, 2010, internet web address: http://www.premierguitar.com/articles/The_Fender_TBX_Tone_Control_Mod_Part_2.

Joe Gore, Two-Band "PTB" Tone Control: Useful, Easy, Cheap & Awesome!, May 22, 2012, internet web address: http://tonefiend.com/guitar/two-band-ptb-tone-control-useful-easy-cheap-awesome/.

Passive Tone Controls Explained, Jul. 28, 2014, internet web address: http://www.bestbassgear.com/ebass/repair/passive-tone-controls-explained.html.

* cited by examiner

TONE CONTROL SYSTEM FOR STRING INSTRUMENTS

BACKGROUND OF THE INVENTION

This disclosure directs itself to a tone control system for string instruments having a pair of pickup transducer sensors coupled in series that permits selective enabling of a filter coupled to a selected one of the pickup transducer sensors, or selectively coupled to the series combination of pickup transducer sensors, or coupling a filter with a selected frequency response to a pickup transducer sensor. More in particular, the disclosure is directed to a tone control system for string instruments that includes a capacitive filter formed by at least one capacitor and one of a potentiometer or a three position switch. Still further, the disclosure is directed to a tone control system where responsive to selective positioning of the displaceable contact of the potentiometer or switch, the signals output by one of the series coupled pickup transducer sensors is selected to be low pass filtered while the other is provided with a high frequency bypass path (high pass filter) or neither of the pickup transducers are filtered. The disclosure is also directed to a tone control system where responsive to selective positioning of the displaceable contact of the potentiometer or switch, the signals output by one of the series coupled pickup transducer sensors is selected to be low pass filtered while the other is provided with a high frequency bypass path (high pass filter), or the series combination of pickup transducer sensors is selected to be low pass filtered, or neither of the pickup transducer sensors are filtered. The disclosure is further directed to a tone control system where responsive to selective positioning of the displaceable contact of the potentiometer or switch, the signals output by one of the pair of series coupled pickup transducer sensors is coupled to a selected one of a pair of filters, each providing a different filter frequency response, or the signals of both of the pickup transducers are unfiltered.

Electric string instruments, such as electric guitars, electric bases, electric violins, etc., use one or more pickup transducers to convert the vibration of the instrument's strings into electrical impulses. The pickup transducers may use sensors formed by piezoelectric devices, optical devices, microphones or magnetic pickup coils. The most commonly used pickup transducers use the principle of direct electromagnetic induction and utilize pickup coils to detect changes in a magnetic field due to the movements of a string. Magnetic transducers include a plurality of permanent magnets to create the magnetic fields that change in response to the movement of the strings and at least one coil as a sensor to detect the magnetic field changes. Transducers having magnetic sensors being the most common, the pickup transducers are themselves often simply called pickup coils, or simply "pickups." The signal generated by the pickup transducers is of insufficient strength to directly drive an audio transducer, such as a loudspeaker, so it must be amplified prior to being input to the audio transducer. The output of some types of pickup transducers may be of sufficient strength to drive an audio transducer such as headphones.

Between the neck and bridge portions of a string instrument the amount of string movement of any of the strings varies, with greater movement occurring in proximity to the neck portion as compared with that adjacent to the bridge portion. Thus, the voltages of the fundamental frequency and lower frequency harmonics (overtones) are generated with greater amplitude in the region of the neck transducer relative to that of the bridge transducer and voltages of higher frequency harmonics of greater amplitude and a lower amplitude fundamental frequency are generated in the region of the bridge transducer relative to that of the neck transducer. Because of this difference it is common for modern electric string instruments to use multiple pickups spaced on the instrument's body between the neck and bridge, and combined and/or selected with blend/configuration controls to achieve a particular sound effect, often in the midst of being played by the musician.

All magnetic pickup coils tend to pick up ambient electromagnetic interference (EMI) from electrical power wiring in the vicinity, such as the wiring in a building, due to their natural inductive qualities. The EMI from a 50 or 60 Hz power system can result in a noticeable "hum" in the amplified audio by from the audio transducer, particularly with poorly shielded single-coil pickups. Double-coil "Humbucker" pickups were invented as a way to overcoming the problem of unwanted ambient hum sounds. Humbucker pickups have two sensing coils arranged to be of opposite magnetic and electric polarity so as to produce a differential signal. As ambient electromagnetic noise effect both coils equally and since they are poled oppositely, the noise signals induced in the two coils cancel out. The two sensing coils of a Humbucker are also usually wired in series to give a fuller and stronger sound. Two individual single sensing coil pickup transducers, if properly poled and polarized, can be combined to suppress hum. Here to, by wiring the two individual sensing coils pickup transducers in series produces a fuller and stronger sound.

Networks formed by ganged or individual potentiometers with series coupled capacitors for "treble control" and parallel coupled capacitors for "bass control" have been used for many years. However, such controls do not give the musician the option for a natural unfiltered sound without the use of a switch to bypass the tone control network. Even with the use of such a switch, such prior art systems do not provide the options of selecting which of a pair of single pickup transducers or sensing coils of a Humbucker pickup transducer the filtering is to be applied. Nor do prior art systems provide the ability to select between applying the filtering to one pickup transducer, or Humbucker sensing coil, and the series combination thereof, or selecting between filters of different frequency response to be a applied to one of the pickup transducers, or Humbucker sensing coil. It is therefore an object of the invention disclosed herein to overcome those, and other deficiencies in the prior art.

SUMMARY OF THE INVENTION

A tone control system for string instruments is provided. The tone control system includes a pair of pickup transducer sensors disposed on a string instrument for generating voltages responsive to vibration of at least one string of the string instrument. The pair of pickup transducer sensors are coupled in series relationship and have a node at a junction between the pair of pickup transducer sensors. The tone control system further includes a capacitive filter. Further, the tone control system includes a tone selection circuit coupled to each of the pair of pickup transducer sensors and the node, and the capacitive filter for selectively enabling the capacitive filter. When enabled, the tone selection circuit couples the capacitive filter in parallel with an alternate one of the pair of pickup transducer sensors.

From another aspect, a tone control system for string instruments is provided that includes a pair of pickup transducer sensors disposed on a string instrument for generating voltages responsive to vibration of at least one string of the string instrument. The pair of pickup transducer sensors are coupled in series relationship and have a node at a junction between the pair of pickup transducer sensors. The tone control system also includes a capacitive filter including a pair of capacitors. Further, the tone control system includes a tone selection circuit coupled to the node and one terminal of each of the pair of capacitors for selectively enabling at least one of the capacitors to function as a low pass filter for voltages generated by at least one of the pair of pickup transducer sensors and function as a high frequency bypass circuit (high pass filter) for at least the other of the pair of pickup transducer sensors.

From yet another aspect, a tone control system for string instruments having a pair of pickup transducer sensors coupled in series relationship is provided. The tone control system includes a capacitive filter. Further, the tone control system includes a tone selection circuit coupled to each of the pair of pickup transducer sensors and a node that defines a connecting junction between the pair of pickup transducer sensors. The tone selection circuit is further coupled to the capacitive filter for selectively enabling the capacitive filter. The tone selection circuit couples the capacitive filter in parallel with an alternate one of the pair of pickup transducer sensors to function as a low pass filter for voltages generated thereby and function as a high frequency bypass circuit (high pass filter) for the other of the pair of pickup transducer sensors.

DETAILED DESCRIPTION OF THE PREFERRED EMBODIMENTS

Figure 1:
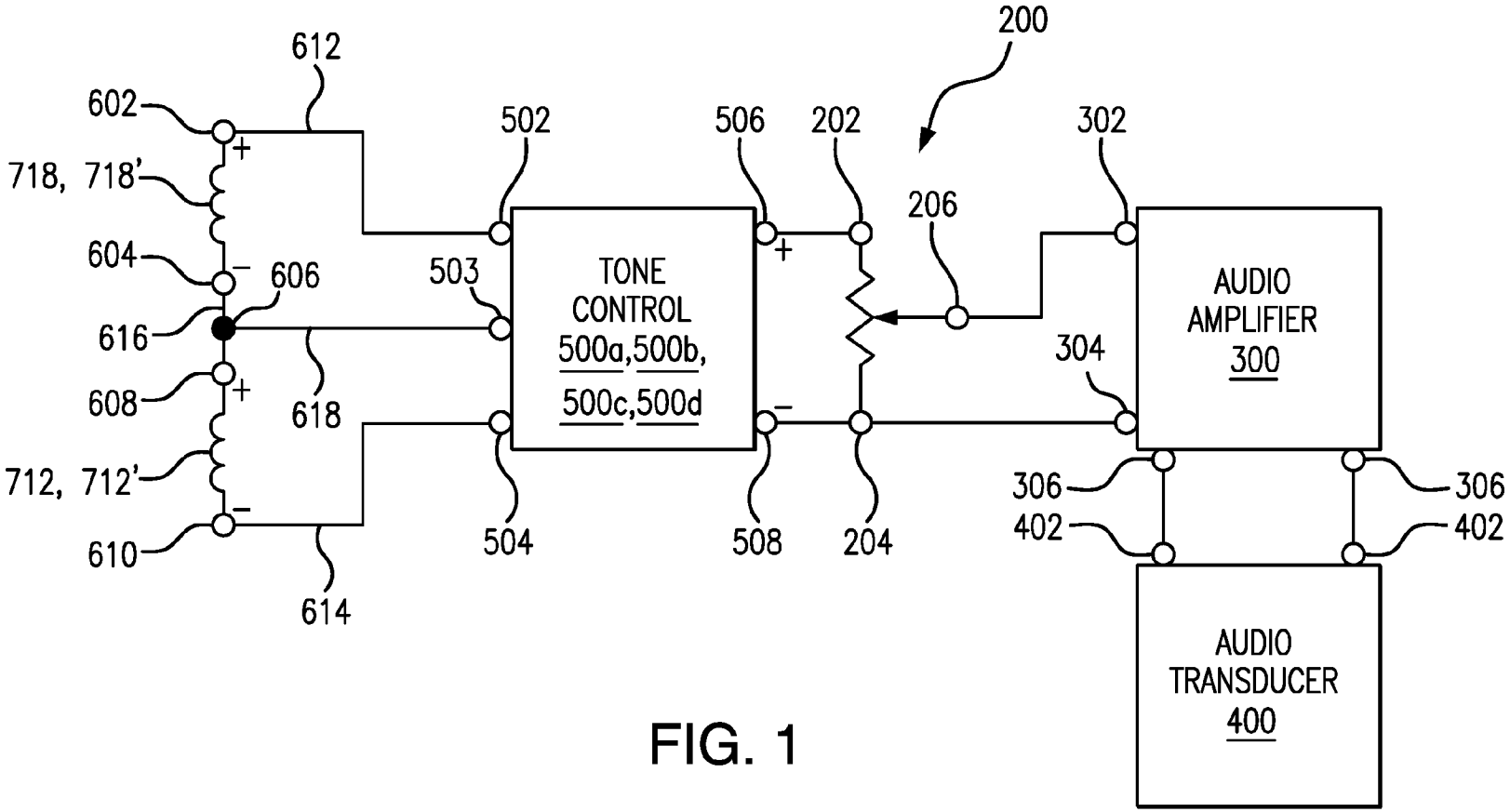
FIG. 1 is a block diagram illustrating the basic audio system for an electric string instrument incorporating the tone control system of the present invention.

Referring to FIGS. 1-7, there is shown tone control system 500*a*, 500*b*, 500*c*, 500*d* for use with an electric string instrument. Electric string instruments, such as electric guitars, electric bases, electric violins, etc. are usable with tone control system 500*a*, 500*b*, 500*c*, 500*d*. Tone control system 500*a*, 500*b*, 500*c*, 500*d* provides selective variation of the filtering applied to the output signals generated by the vibration sensing pickup transducers of the electric string instrument. The filtering arrangement provided by tone control system 500*a*, 500*b*, 500*c*, 500*d* provides a unique combination of high pass and low pass filtering to complement the location of a pair of pickup transducers 710, 720 or the magnetic pickup sensors (coils) 712' and 718' of a Humbucker transducer 720' of the electric string instrument 700 and provide a variation of sound that range from rock to jazz to blues. Tone control system 500*a*, 500*b*, 500*c*, 500*d* is applicable for use with a pair of single pickup transducers 710, 720 as well as a Humbucker pickup 720' and the output thereof can be combined with the output of other tone control systems coupled to corresponding pairs of pickups using a blend/configuration control known in the art.

As is known in the art, one or more pickup transducers are positioned in correspondence with the strings of the instrument so that they are able to produce an electrical signal in response to vibration of at least one of the multiple strings of the instrument. The transducers may use sensors formed by piezoelectric devices, optical devices, microphones or the more commonly used magnetic pickup coils. Humbucker type pickups are often used with electric string instruments because they provide for cancellation of electromagnetic interference (EMI), such as the 50 or 60 Hz "hum" that is induced from nearby electrical power wiring. Humbucker type pickup transducers typically have two pickup sensing coils in a single package that are phased and poled to provide cancellation of "out of phase" signals. A pair of separately located single sensing coils can also be connected with opposing respective phases and magnetic polarity to provide cancellation of EMI as well.

Tone control system 500*a*, 500*b*, 500*c*, 500*d* may be used with a pair of collocated pickup transducer sensor coils 712', 718' of a single Humbucker transducer 720', as well as separately located pickup transducers 710, 720 and located anywhere along the longitudinal extent of the strings 10 on the instrument 700. In fact, each of the separately located pickup transducers 710, 720 may be replaced by Humbucker transducers where the collocated pickup transducer sensor coils of each Humbucker transducer are coupled in series or parallel. The series or parallel pair of pickup transducer sensor coils of the Humbucker transducer closest to the bridge is connected to the input terminals 502 and 503, and the series or parallel pair of pickup transducer sensor coils of the Humbucker transducer closest to the neck is connected to the input terminals 503 and 504. Similarly, one of the pickup transducers 710 or 720 can be connected in series with the pair of sensor coils of a Humbucker transducer coupled in series or parallel and may be combined with pickup selector switches or blend controls. Thus, it can be seen that any number of pickup sensors can be combined into two series coupled groups of pickup sensors without departing from the inventive concepts disclosed herein. When magnetic type pickup transducers are used, they may be phased to provide noise cancellation or not, without departing from the inventive concepts embodied in tone control system 500*a*, 500*b*, 500*c*, 500*d*. In particular, tone control system 500*a*, 500*b*, 500*c*, 500*d* can be used to alter the filtering of signal frequencies provided by active or passive pickup transducers and may be used in combination with any pickup transducer switching and/or blend controls that are used to select or mix the signals from the multiple sets of pickup transducer sensors.

Referring more specifically to FIG. 1, there is shown a block diagram of the basic audio system for an electric string instrument that incorporates the novel tone control system 500*a*, 500*b*, 500*c*, 500*d* disclosed herein. A pair of series coupled pickup transducer sensors 712, 712' and 718, 718' generate voltage signals responsive to the vibrational movement of the strings of a stringed instrument, such as guitars, violins, cellos, harps, banjos, mandolins, bases, etc. Although pickup transducer sensors 712 and 718 are illustrated as coils of a magnetic type pickup transducer, they may be any type of pickup transducer sensor capable of outputting voltages in correspondence to vibration of the strings of the instrument, including piezoelectric devices, optical devices, microphones or magnetic pickup coils. The voltage signals generated by the pickup transducers sensors 712, 712' and 718, 718' are output to terminals 602, 610 and node 606, which are respectively connected to input terminals 502, 503 and 504 of tone control system 500*a*, 500*b*, 500*c*, 500*d* by the coupling lines 612, 618 and 614. Each of the pickup transducer sensors 712, 712' and 718, 718' generate signals responsive to the vibratory displacement of the instruments strings that are output at the terminals 602 and 604, and 608 and 610, respectively. The outputs 602 and 610 are respectively coupled to input terminals 502 and 504 of tone control system 500*a*, 500*b*, 500*c*, 500*d*. The outputs 604 and 608 are joined together at node 606, which is in turn connected to input terminal 503 of tone control system 500*a*, 500*b*, 500*c*, 500*d*.

Modern electric string instruments, often incorporate multiple Humbucker type pickup transducers, for example one located near the bridge of the instrument and another near the neck of the instrument, with blend controls being included in the instrument to mix the signals from those transducers. String instruments with three or four such pickup transducers and a blend control to combine them are not unheard of, and each is usable with the tone control system disclosed herein. Each of such Humbucker type pickup transducer would be respectively connected to a separate tone control system 500*a*, 500*b*, 500*c*, 500*d* and the output therefrom to a blend control, as is known in the art.

As will be described in following paragraphs, tone control system 500*a*, 500*b*, 500*c*, 500*d* applies different filter selections responsive to the selective positioning of a potentiometer displaceable contact, or alternately, responsive to a displaceable contact of a switch. Although a switch can be substituted for the potentiometer to affect the different filter selections, the use of a potentiometer provides the advantage of providing soft transitions between those selections and thereby gives a "blended" effect between the sounds.

Tone control system 500*a*, 500*b*, 500*c*, 500*d*, outputs the signal at terminals 506 and 508, which are respectively connected to terminals 202 and 204 of a volume control 200. Volume control 200 is a potentiometer that functions as a voltage divider with its displaceable contact connected to an output terminal 206. The signal level at the output terminal 206 relative to terminal 204 will be in relation to the resistance between those terminals with respect to the total resistance between terminals 202 and 204. The output of volume control 200 provided from terminals 206 and 204 are respectively coupled to terminals 302 and 304 of an audio amplifier 300.

Audio amplifier 300 increases the signal level, voltage and current, sufficiently to drive an audio transducer 400, such as headphones or one or more speakers. The output terminals 306 of audio amplifier 300 are connected to the input terminals 402 of audio transducer 400. Although, audio amplifier 300 is shown with a single pair of output terminals, it should be understood that multiple separate outputs may be provided to simultaneously drive a plurality of audio transducers 400.

Figure 2A:
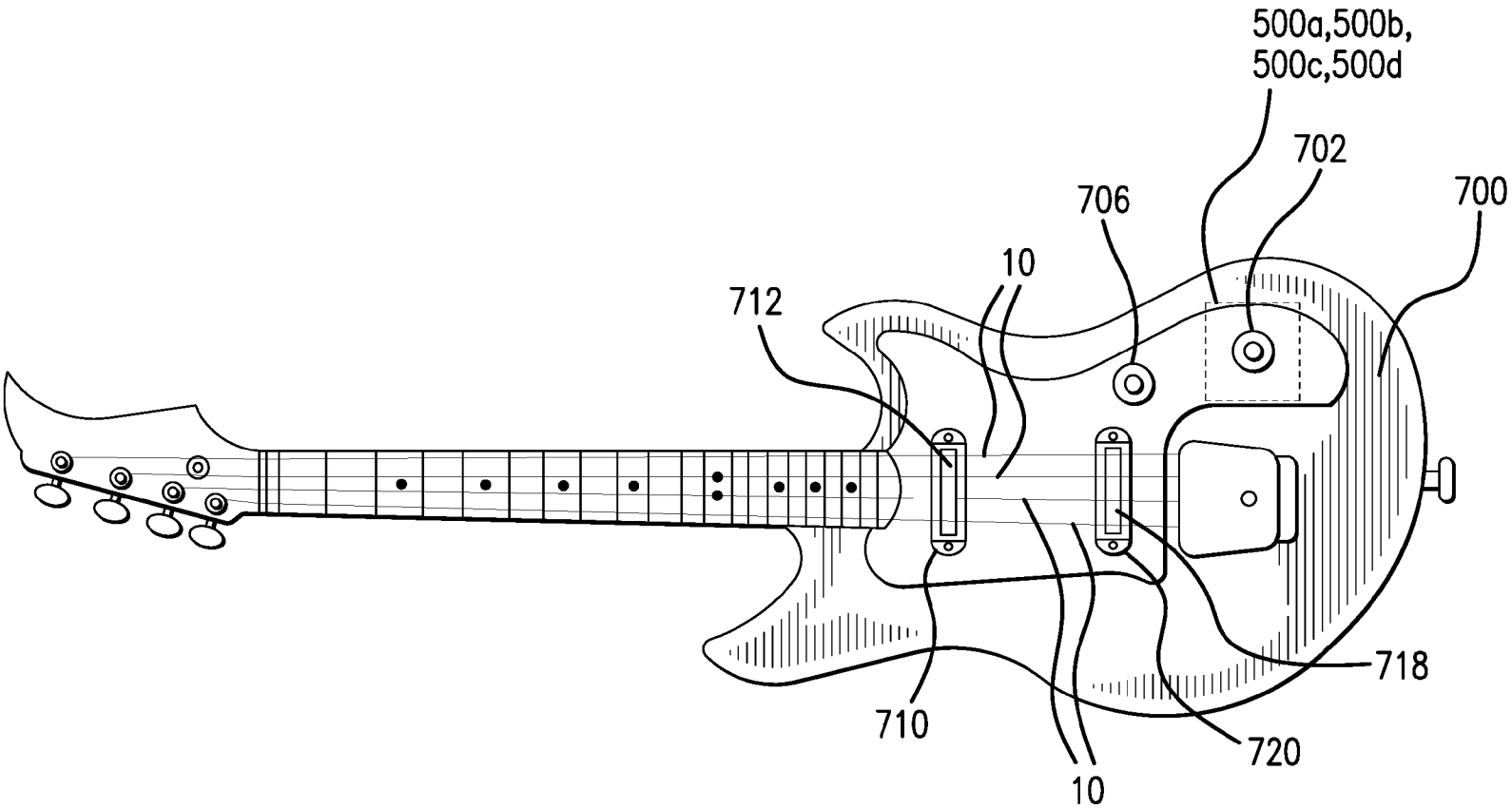
FIG. 2A is an illustration of an electric string instrument showing typical locations of a pair of pickup transducers for sensing string vibrations in conjunction with the present invention.

Turning now to FIG. 2A, there is illustrated an exemplary electric string musical instrument 700 in the form of an electric guitar. As is typical of such musical instruments, electric guitar 700 includes a plurality of strings 10, the vibrations of which are sensed by the pickup transducers 710 and 720. Although only a single pickup transducer is necessary for the electric guitar to function as a musical instrument, a broad range and variation of sounds can be generated using multiple pickup transducers spaced longitudinally one from another along a portion of the longitudinal extent of the strings. For simplicity, the pickup transducers 710 and 720 will be exemplified as single coil magnetic type transducers, however, the inventive concepts disclosed herein are equally applicable to other types of transducers used with electric string instruments. The transducer 720 is located in proximity to the bridge of the instrument and includes a pickup transducer sensor 718 in the form of the pickup coil in which voltages are induced responsive to vibrations of the strings 10. Similarly, transducer 710, located in proximity to the neck of the instrument, includes a pickup transducer sensor 712 in the form of pickup coil in which voltages also are induced responsive to vibrations of the strings 10. The electric string musical instrument 700 has at least a rotary knob 706 connected to the potentiometer of volume control 200, previously described with respect to FIG. 1. The tone control system 500*a*, 500*b*, 500*c*, 500*d* is incorporated into the electric string musical instrument 700 and is operated by the knob 702, which may have a different appearance than that depicted in the figure, as when a switch is utilized to change the filter connection to the pickup transducer sensors.

Figure 2B:
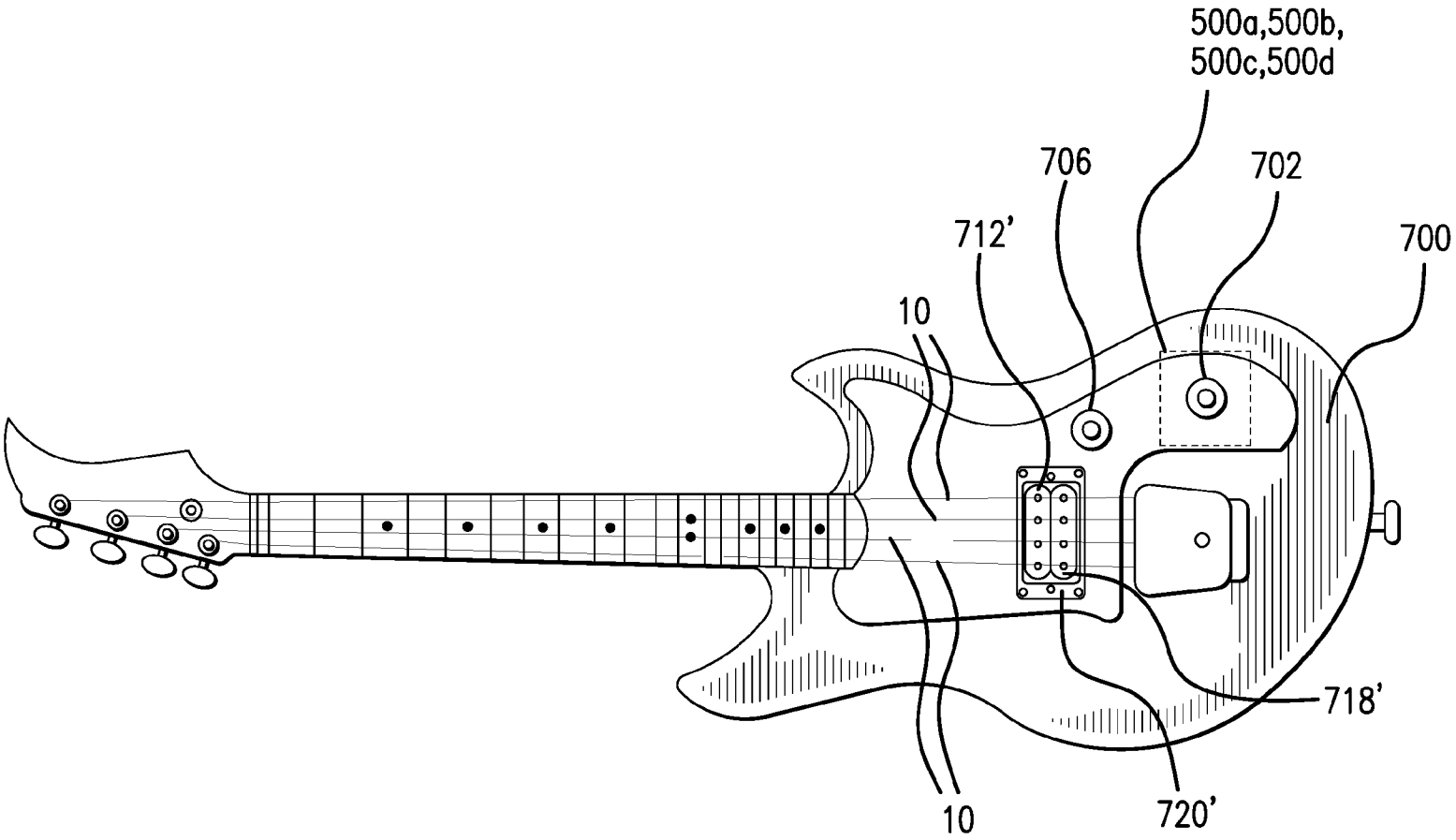
FIG. 2B is an illustration of an electric string instrument showing typical locations of a Humbucker type pickup transducer for sensing string vibrations in conjunction with the present invention.

In FIG. 2B, there is illustrated an exemplary electric string musical instrument 700 in the form of an electric guitar differing only from that of FIG. 2A in that it has a Humbucker pickup transducer 720' disposed in correspondence to the plurality of strings 10 in place of the individual transducers 710 and 720. The vibrations of the strings 10 are sensed by the pickup transducer sensors 712' and 718' which are pickup coils of the Humbucker pickup transducer 720'. The transducer 720' is shown located in proximity to the bridge of the instrument, but could be located in proximity to the neck or an intermediate location. Regardless of where the transducer 720' is located, one pickup transducer sensor, in the form of pickup coil 718', will be closer to the bridge than the other pickup transducer sensor, in the form of pickup coil 712', which will accordingly be closer to the neck. This smaller difference in longitudinal spacing between the pickup coils 718' and 712' will still result in a corresponding difference in harmonic frequencies respectively sensed by those pickup coils 718' and 712'. Hereto, the electric string musical instrument 700 has at least a rotary knob 706 connected to the potentiometer of volume control 200, previously described with respect to FIG. 1. The tone control system 500*a*, 500*b*, 500*c*, 500*d* is incorporated into the electric string musical instrument 700 and is operated by the knob 702, which may have a different appearance than that depicted in the figure, as when a switch is utilized to change the filter connection to the pickup transducer sensors.

Figure 2C:
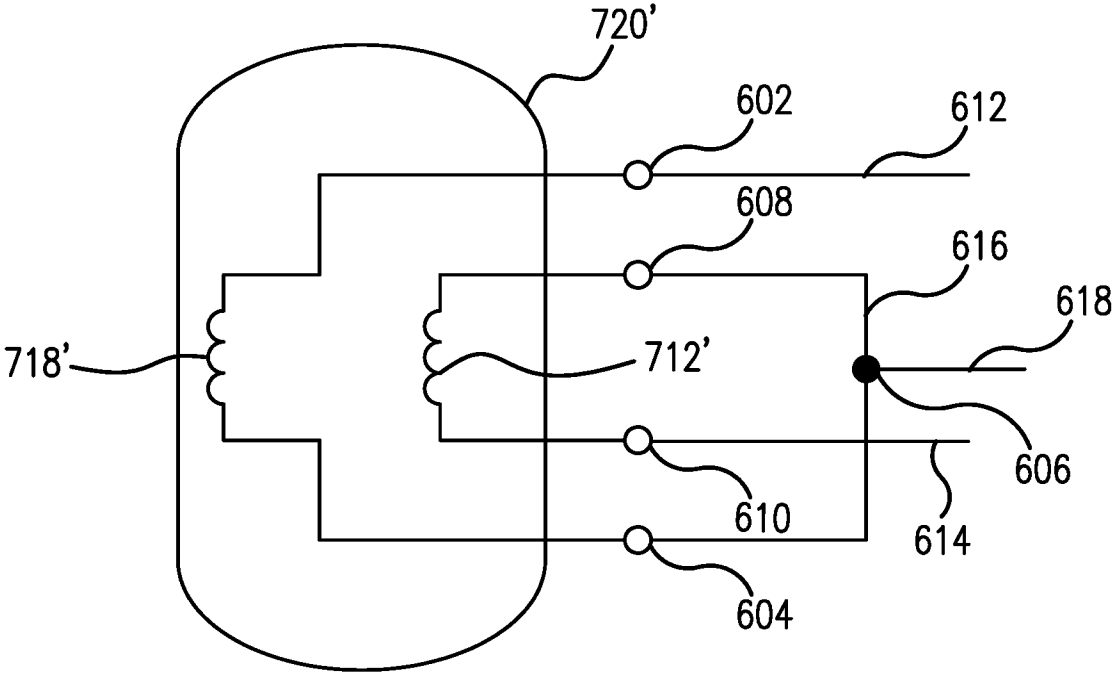
FIG. 2C is a schematic illustration of a Humbucker type pickup transducer for string instruments with the pickup coil sensors thereof connected in series.

Referring additionally to FIG. 2C, the Humbucker transducer 720' is shown to include a pair of pickup transducer sensors 712' and 718' within a single enclosure that is mounted to the instrument 700. The pickup coil 718' is connected between the terminals 602 and 604 and the pickup coil 712' is connected between the terminals 608 and 610. The two pickup coils 718' and 712' are connected in series by the coupling line 616 that interconnects terminals 604 and 608, and has a connection node 606 connected to the coupling line 618, the connection of which is shown in FIG. 1. Each of terminals 602 and 610 are respectively coupled to coupling lines 612 and 614, the connection of which is also shown in FIG. 1.

As the portion of each of the strings 10 overlaying the pickup coil 718, 718' are limited in their relative displacement by their respective proximity to the bridge as compared to the portions of the corresponding strings overlaying the pickup coil 712, 712', they generate voltages with different combinations of frequencies. Accordingly, applying the same low pass filter to selectively one pickup transducer sensor 712, 712' or the other pickup transducer sensor 718, 718' produces a different effect. A different effect is also produced by applying one low pass filter to one pickup transducer sensor 712, 712' or anther low pass filter to the series combination of the pickup transducer sensors 712, 712' and 718, 718' or the one pickup transducer sensor 712, 712'. When the low pass filter is applied to one of the pickup transducer sensors 712, 712' or 718, 718' and is defined by at least one capacitor, it is connected in parallel therewith to thereby form a low impedance circuit path for the higher frequency components of the voltage generated by the paralleled pickup transducer sensor, as a function of the filter capacitor value, to essential "short out" the higher frequency components generated by the paralleled pickup transducer sensor. Since the pickup transducer sensors are connected in series, the filter capacitor is connected in series with the other of the pickup transducer sensors and forms a high frequency bypass circuit path for the high frequency components generated by the other of the pickup transducer sensors 718, 718' or 712, 712', and will be further described in following paragraphs.

As discussed with respect to FIG. 1, tone control system 500*a*, 500*b*, 500*c* and 500*d* includes input terminals 502, 503 and 504 that are coupled to the series combination of the pickup transducer sensors 718, 718' and 712, 712'. Pickup transducer sensor 718, 718' has a pair of terminals 602 and 604 where the terminal 602 is coupled to the input terminal 502 by the conductor 612. Likewise, pickup transducer sensor 712, 712' has a pair of terminals 608 and 610 where the terminal 610 is coupled to the input terminal 504 by the conductor 614 and the terminal 608 is coupled to the terminal 604 by the conductor 616. Conductor 616 is also electrically connected to input terminal 503 by the conductor 618 through a connection node 606. Tone control system 500*a*, 500*b*, 500*c* and 500*d* further includes output terminals 506 and 508.

Figure 3A:
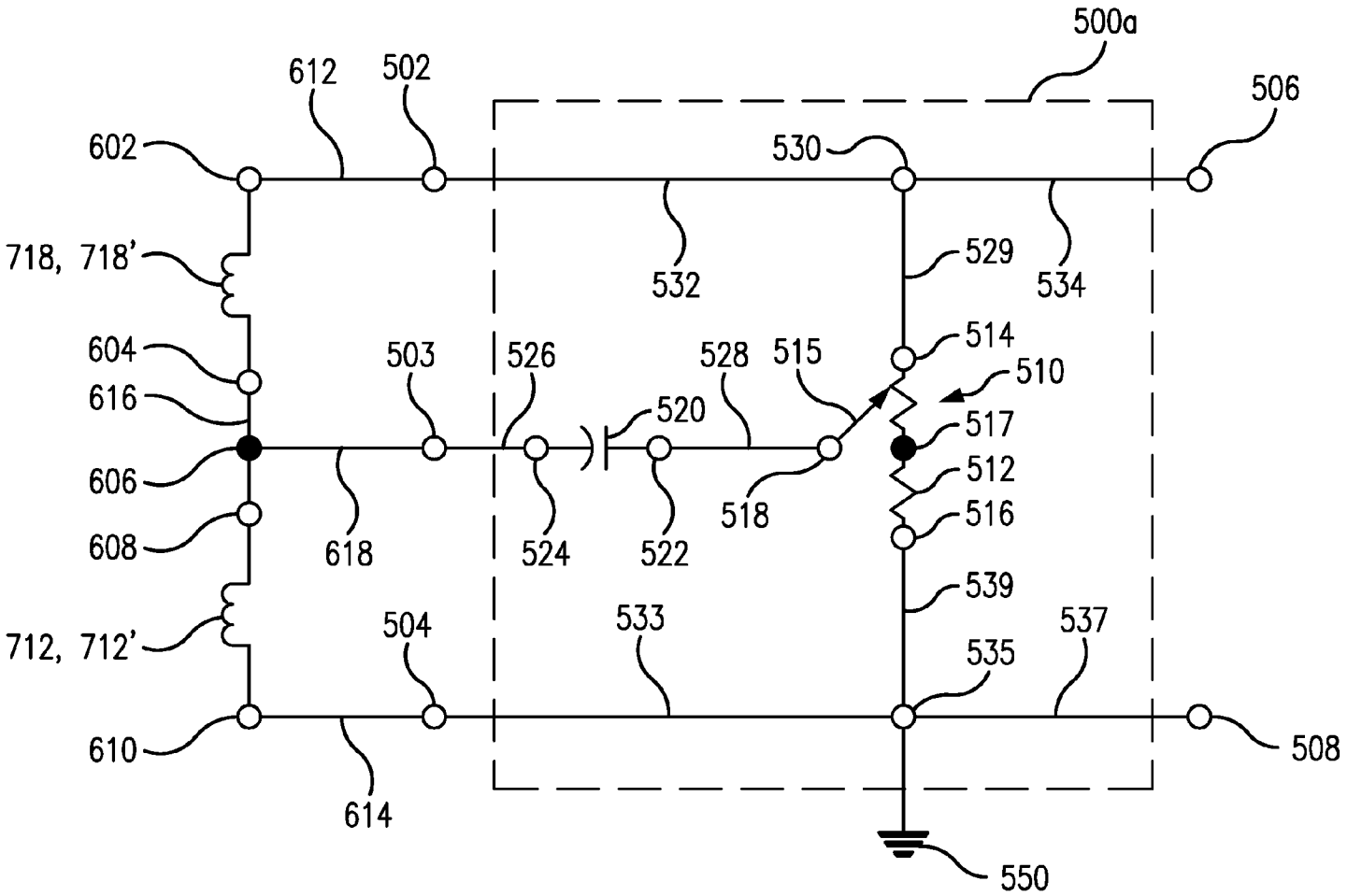
FIG. 3A is a schematic electrical diagram of the tone control system adjusted for a low pass configuration applied to a first of the pickup transducers.
Figure 3B:
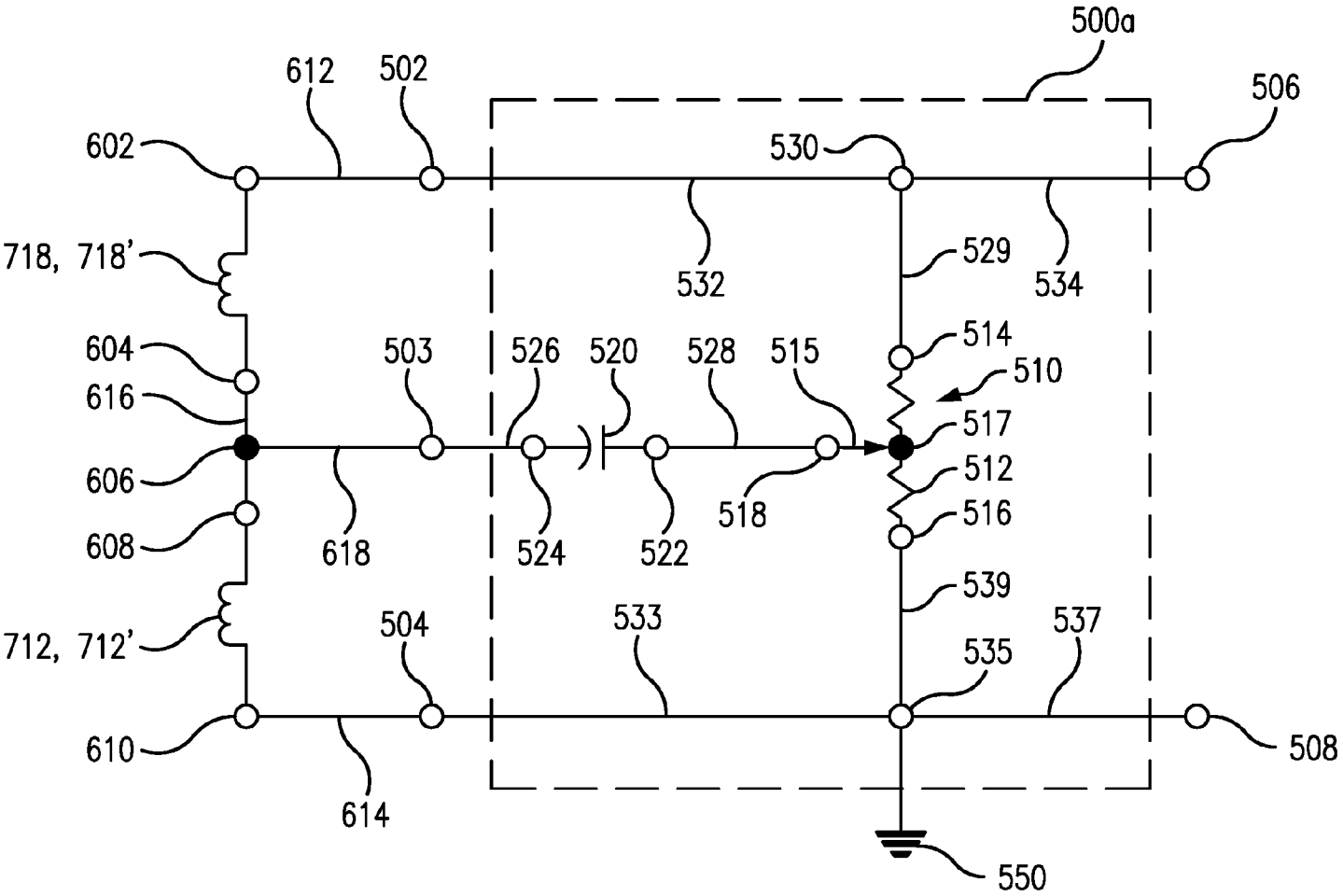
FIG. 3B is a schematic electrical diagram of the tone control system of FIG. 3A adjusted for an unfiltered configuration.
Figure 3C:
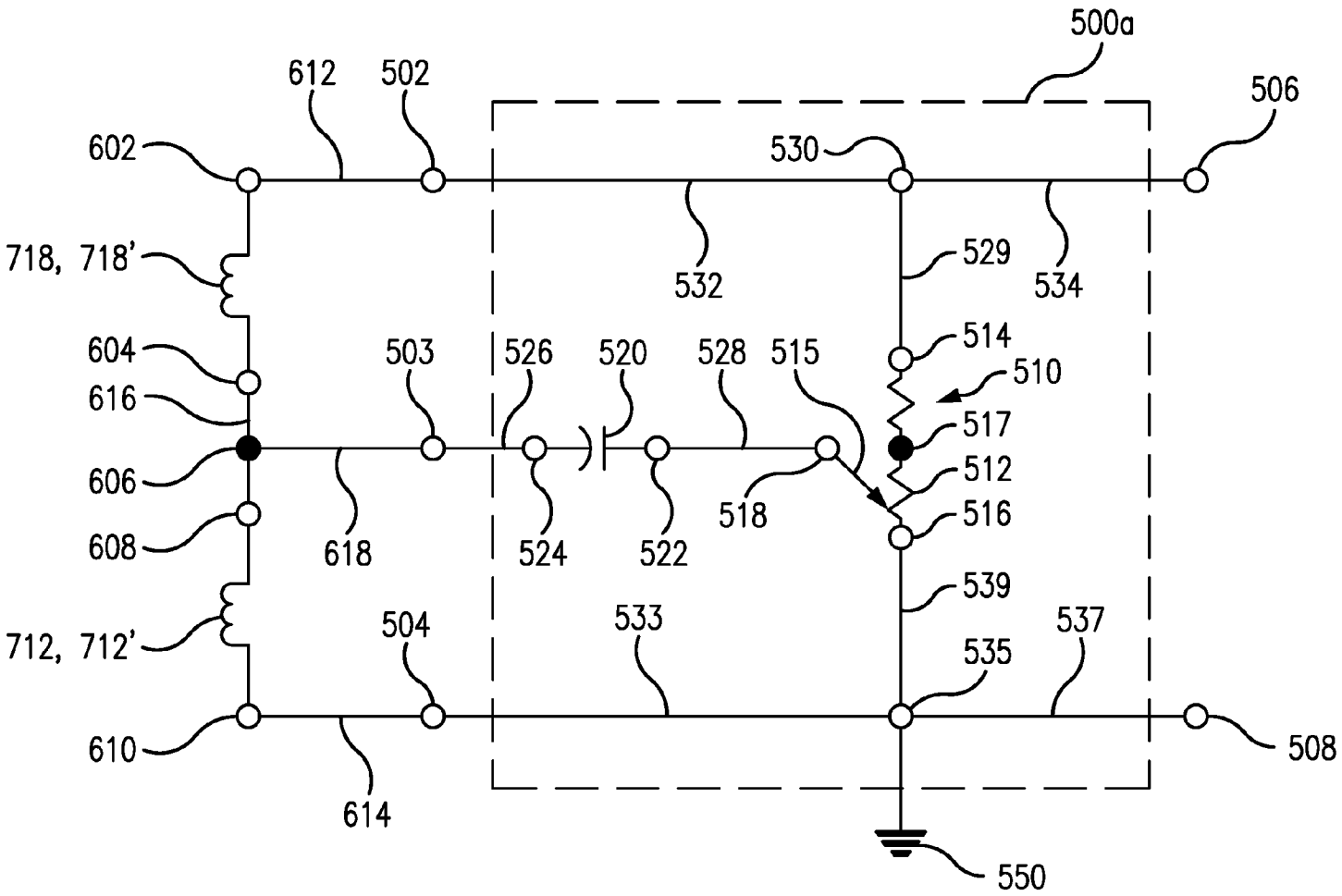
FIG. 3C is a schematic electrical diagram of the tone control system of FIG. 3A adjusted for a low pass configuration applied to the second of the pickup transducers.

Referring now to FIGS. 3A, 3B and 3C there are shown schematic diagrams of tone control system 500*a* at different respective settings to demonstrate the changes in the filtering configurations that are obtained therewith. Tone control system 500*a* includes a filter capacitor 520 having a pair of terminals 522 and 524, and a potentiometer 510 having terminals 514, 516 and 518. Filter capacitor 520 may be any of a wide variety of types of capacitors, such as paper, ceramic disc, or any of a wide variety of film capacitors. Filter capacitor 520 may have a capacitance value within the range of 20 nf to 47 nf and preferably within the range of 27 nf to 33 nf. As the value of capacitance chosen is influenced by the type of string instrument and/or style of music with which it is used other values may be used. Potentiometer 510 has a resistance element 512 that may have a resistance value within the range of 100 kΩ to 1 MΩ, but preferably has a resistance value in the range of 250 kΩ to 500 kΩ with a linear taper and a detent 517 at the center of the mechanical travel of displaceable contact 515 thereof. The resistance element 512 is connected between terminals 514 and 516 and the displaceable contact 515 is connected to terminal 518.

Input terminal 503 is connected to terminal 524 of filter capacitor 520 by the conductor 526 and the opposing terminal 522 of the filter capacitor 520 is connected to terminal 518 of potentiometer 510 by the conductor 528. Input terminal 502 is connected to both the output terminal 506 and the terminal 514 of potentiometer 510 through conductor 532, intermediate terminal 530 and the respective conductors 534 and 529. Similarly, the input terminal 504 is connected to both the output terminal 508 and the terminal 516 of potentiometer 510 through conductor 533, intermediate terminal 535 and the respective conductors 537 and 539. The intermediate terminal 535 is also connected to the ground reference potential 550.

The functioning of tone control system 500*a* will now be described, beginning with the displaceable contact 515 being at a first end of the mechanical travel thereof, as shown in FIG. 3A. In this position, the resistance between the displaceable contact 515 and the potentiometer terminal 516 is at a maximum and for practical purposes functions as an open circuit. Conversely, the resistance between the displaceable contact 515 and the potentiometer terminal 514 is at a minimum to thereby function as a short circuit, electrically connecting the filter capacitor terminal 522 to the terminal 602 of the pickup transducer sensor 718, 718'. As the opposing filter capacitor terminal 524 is electrically connected to the node 606 and thereby to the opposing pickup transducer sensor terminal 604, filter capacitor 520 is thereby coupled in parallel with the pickup transducer sensor 718, 718'. Accordingly, the low frequency component currents generated by pickup transducer sensors 718, 718' and 712, 712' flows from input terminal 502 to output terminal 506, returning to output terminal 508 and flowing to input terminal 504 to return to the series coupled pickup transducer sensors.

The high frequency component current generated by pickup transducer sensor 718, 718' flowing to input terminal 502 flows through capacitor 520 to pickup transducer sensor terminal 604 via input terminal 503 and node 606. Therefore, by this arrangement, the high frequency components generated by pickup transducer sensor 718, 718' are substantially suppressed (essentially shorted as a function of their frequency and the capacitance value of capacitor 520). Thus, filter capacitor 520 defines a low pass filter for pickup transducer sensor 718, 718'. The high frequency components, however, generated by pickup transducer sensor 712, 712' which would otherwise be suppressed by the inductance of pickup transducer sensor 718, 718', flow from node 606 to input terminal 503 and through the filter capacitor 520 to output terminal 506 (also as a function of their frequency and the capacitance value of capacitor 520); returning through output terminal 508 and input terminal 504 to the pickup transducer sensor terminal 610. For pickup transducer sensor 712, 712' filter capacitor 520 functions as a high pass filter (passing signals above a particular frequency), serving as a high frequency bypass circuit path. Thus, with the displaceable contact 515 being at the first end of the mechanical travel of potentiometer 510, the capacitor 520 provides suppression of high frequencies generated by the pickup transducer sensor 718, 718', located closest to the bridge, and the bypassing of the high frequencies generated by pickup transducer sensor 712, 712', located closest to the neck. For a guitar incorporating tone control system 500*a*, setting the displaceable contact at the first position provides a sound typically preferred by musicians who play the "Blues" genre of music.

As shown in FIG. 3B, the potentiometer 510 is set at an intermediate position of the mechanical travel of displaceable contact 515, which is preferably the midpoint thereof and may incorporate a mechanical detent 517 thereat to provide a tactile indication of that position to the musician playing the instrument. With the displaceable contact 515 at the midpoint of its mechanical travel and a linear taper of the resistive element 512, the resistance between the potentiometer terminal 518 and each of potentiometer terminals 514 and 516 are substantially equivalent and equal to one half the total resistance of resistance element 512. Fifty percent of the resistance of resistive element 512 is sufficiently high so that for practical purposes no current flows between terminal 518 and either of terminals 514 and 516 in this position of displaceable contact 515. Accordingly, filter capacitor 520 is isolated from both of the pickup transducer sensors 718, 718' and 712, 712' and there is no low pass filtering or high frequency bypass current path for either of the pickup transducer sensors. For the guitar 700 with the potentiometer 510 set at the intermediate position of the mechanical travel of displaceable contact 515, the sound produced will be of the type typically preferred by "Classic Rock" musicians.

At intermediate positions of the displaceable contact 515 between the position of the detent 517 and the first end of potentiometer 510, shown in FIG. 3A, the amount of resistance connected in series with capacitor 520, which together are connected in parallel with pickup transducer sensor 718, 718' and connected in the bypass circuit path in series with the pickup transducer sensors 712, 712', is proportionately reduced or increased, as a function of the direction of displacement of displaceable contact 515. That varying amount of resistance has the effect of blending in, or blending out, the effect of the capacitor as the potentiometer is adjusted, effectively softening the transition between no filter and the full filtering effect.

In FIG. 3C, the displaceable contact 515 is set at the second end of the mechanical travel thereof. In that position, the resistance between the displaceable contact 515 and the potentiometer terminal 514 is at a maximum and for practical purposes functions as an open circuit. Whereas, the resistance between the displaceable contact 515 and the potentiometer terminal 516 is at a minimum to thereby function as a short circuit, electrically connecting the filter capacitor terminal 522 to the terminal 610 of the pickup transducer sensor 712, 712'. As the opposing filter capacitor terminal 524 is electrically connected to the node 606 and thereby to the opposing pickup transducer sensor terminal 604, filter capacitor 520 is thereby coupled in parallel with the pickup transducer sensor 712, 712'. Hence, when displaceable contact 515 is set at the second end of the mechanical travel, filter capacitor 520 forms a low pass filter for pickup transducer sensor 712, 712' and a high frequency bypass for pickup transducer sensor 718, 718', the opposite of that which is obtained when the displaceable contact 515 is set at the first end of its mechanical travel. Since the pickup transducer sensor 718, 718', being closest to the bridge, generates more high frequency harmonics, the sound effect of this filter configuration differs from that produced by the setting shown in FIG. 3A and for guitar 700 produces a sound typically preferred by musicians who play the "Jazz" or "Rhythm" genre of music.

Yet again, at intermediate positions of the displaceable contact 515 between the position of the detent 517 and the second end position of potentiometer 510 shown in FIG. 3C, the amount of resistance connected in series with capacitor 520, which together are connected in parallel with pickup transducer sensor 712, 712' and connected in the bypass path in series with the pickup transducer sensors 718, 718', is proportionately reduced or increased, as a function of the direction of displacement of displaceable contact 515. That varying amount of resistance has the effect of blending in or blending out the effect of the capacitor as the potentiometer is adjusted, effectively softening the transition between the conditions of no filter and the full filtering effect.

Figure 4A:
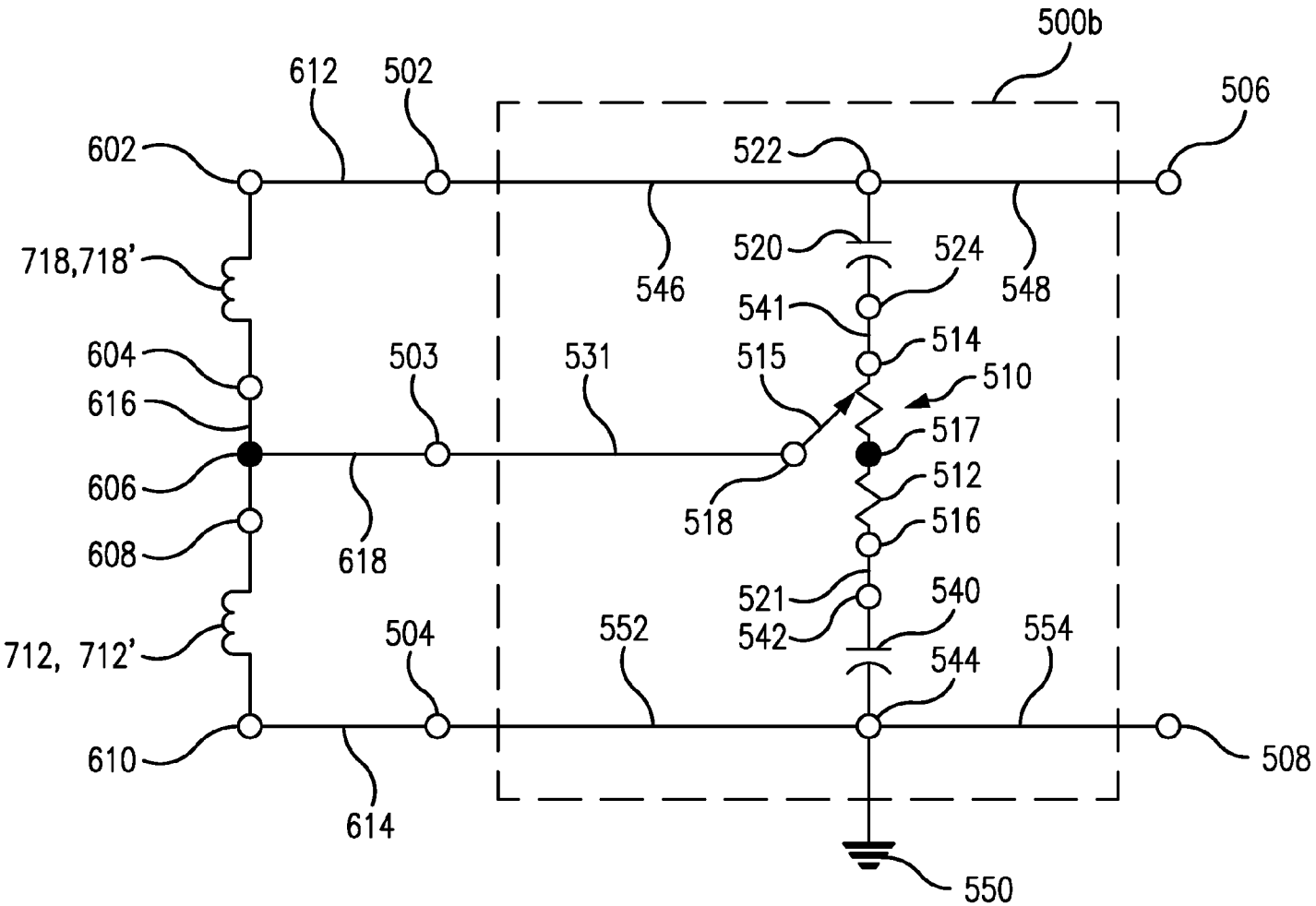
FIG. 4A is a schematic electrical diagram of another arrangement of the tone control system adjusted for a low pass configuration applied to a first of the pickup transducers.
Figure 4B:
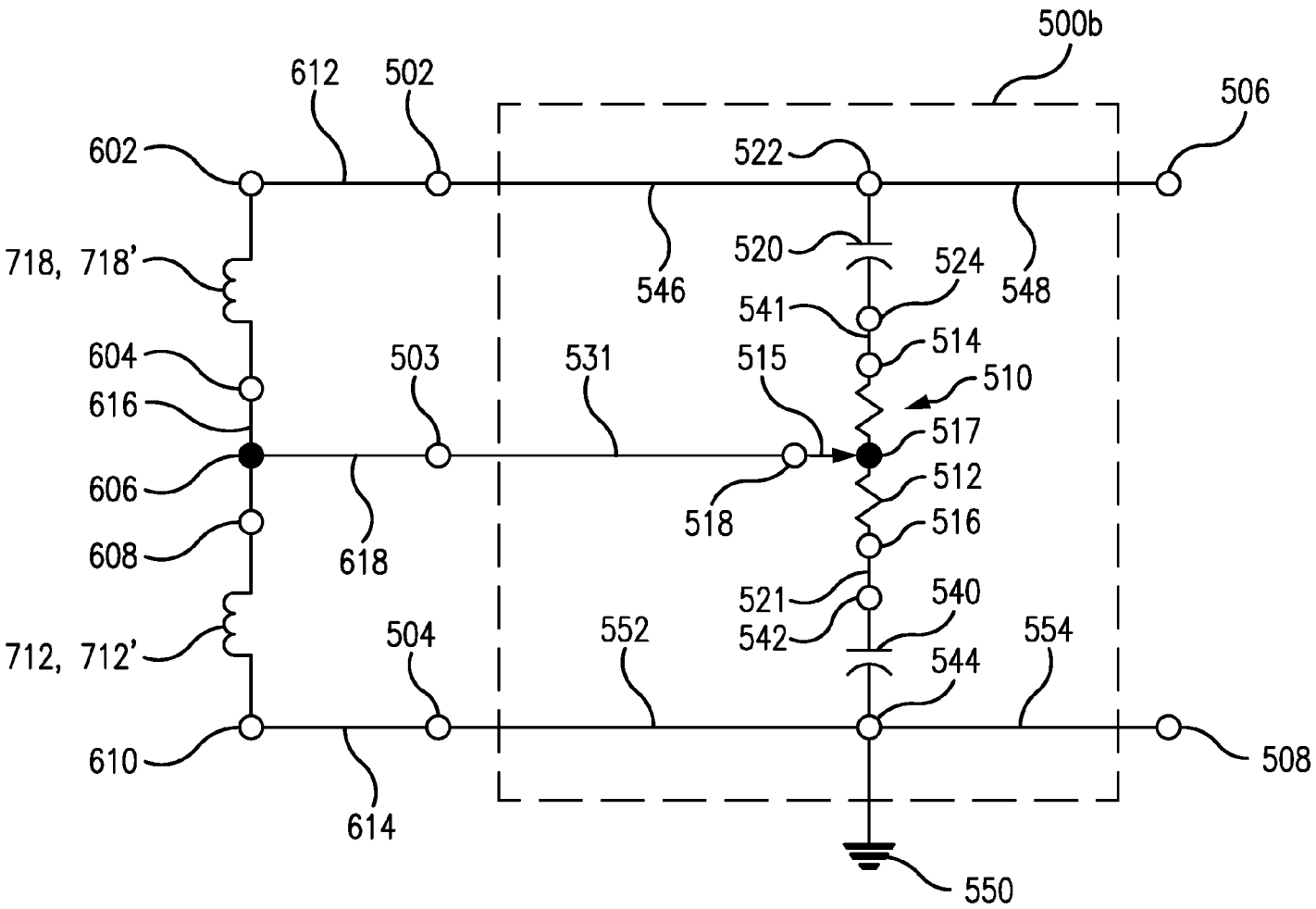
FIG. 4B is a schematic electrical diagram of the tone control system of FIG. 4A adjusted for an unfiltered configuration.
Figure 4C:
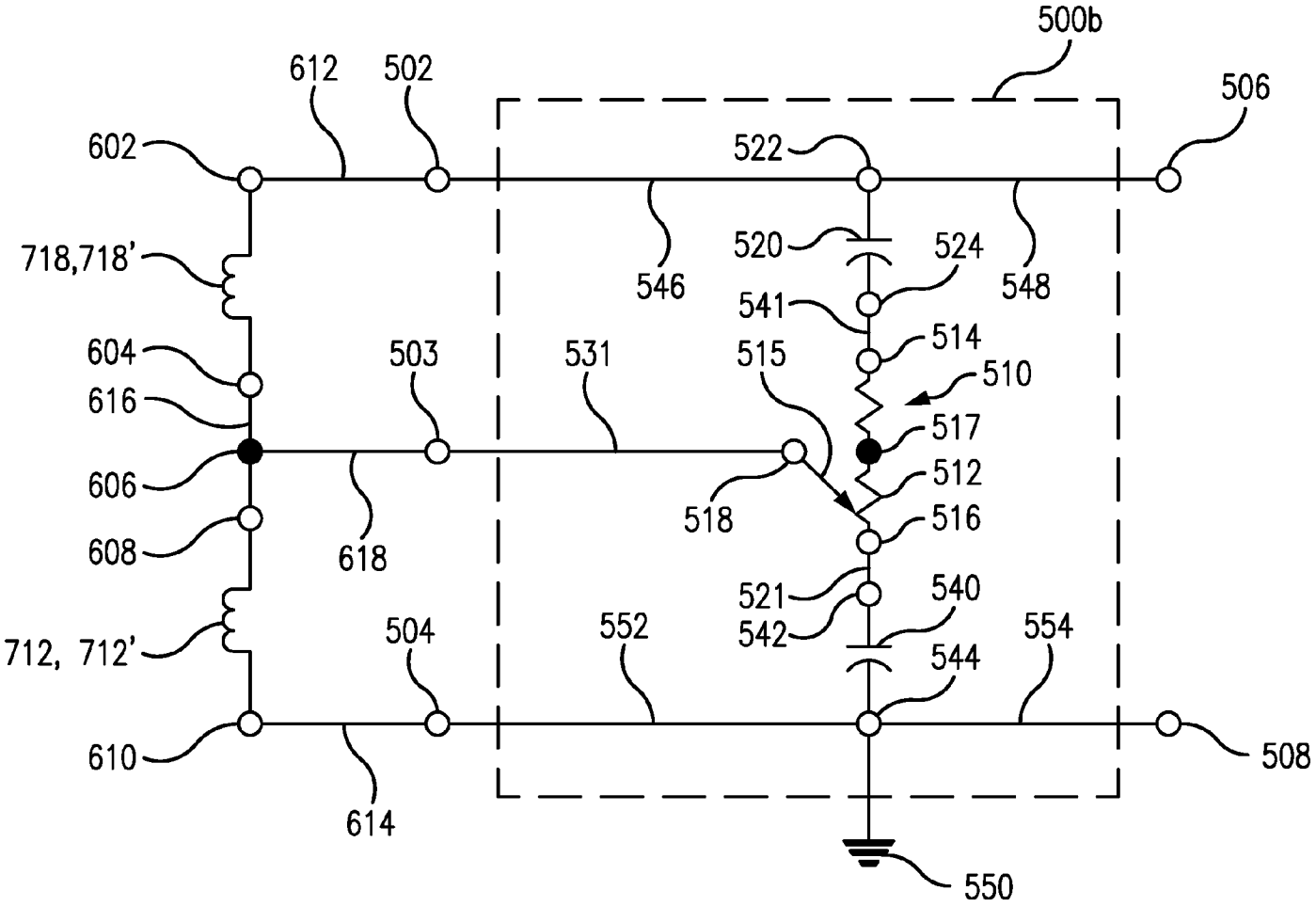
FIG. 4C is a schematic electrical diagram of the tone control system of FIG. 4A adjusted for a low pass configuration applied to the second of the pickup transducers.

Referring to FIGS. 4A, 4B and 4C there are shown schematic diagrams of tone control system 500*b* at different respective settings to demonstrate the changes in the filtering configurations that are obtained therewith. Like tone control system 500*a*, tone control 500*b* provides for the selective coupling of a low pass filter-high frequency bypass capacitor with an alternate one of the two series coupled pickup transducer sensors 718, 718' and 712, 712', but differs in that it provides filters of different capacitance values to be respectively selectively coupled to the two pickup transducer sensors. Tone control system 500*b* includes a pair of filter capacitors 520 and 540. Capacitor 520 has a pair of terminals 522 and 524, and capacitor 540 has a pair of corresponding terminals 542 and 544. Tone control system 500*b* also includes a potentiometer 510 having terminals 514, 516 and 518. Filter capacitors 520 and 540 may be any of a wide variety of types of capacitors, such as paper, ceramic disc, or any of a wide variety of film capacitors. By virtue of their different positions along the longitudinal extent of the strings, pickup transducer sensors 718, 718' and 712, 712' generate signals with different high frequency harmonics. As the pickup transducer sensor closest to the bridge generates the higher frequency harmonics, a capacitor with a lower capacitance value is suitable for use as the low pass filter therefore. Thus, filter capacitor 520 may have a capacitance value within the range of 20 nf to 47 nf and preferably within the range of 27 nf to 33 nf, and filter capacitor 540 may have a capacitance value within the range of 27 nf to 100 nf and preferably within the range of 33 nf to 68 nf, with the capacitance of capacitor 540 being selected to be greater than that selected for capacitor 520. As previously described, potentiometer 510 has a resistance element 512 that may have a resistance value within the range of 100 kΩ to 1 MΩ, but preferably has a resistance value in the range of 250 kΩ to 500 kΩ with a linear taper and a detent 517 at the center of the mechanical travel of displaceable contact 515 thereof. The resistance element 512 is connected between terminals 514 and 516 and the displaceable contact 515 is connected to terminal 518.

Input terminal 503 is connected to the displaceable contact terminal 518 of potentiometer 510 by the conductor 531. Input terminal 502 is connected to both the output terminal 506 and the terminal 522 of capacitor 520 through respective conductors 546 and 548. Likewise, the input terminal 504 is connected to both the output terminal 508 and the terminal 544 of capacitor 540 through respective conductors 552 and 554. The terminal 544 of capacitor 540 is also connected to the ground reference potential 550. The opposing terminal 524 of capacitor 520 is connected to terminal 514 of potentiometer 510 by the conductor 541 and the opposing terminal 542 of capacitor 540 is connected to terminal 516 of potentiometer 510 by the conductor 521.

The functioning of tone control system 500*b* will now be described, beginning with the displaceable contact 515 being at a first end of the mechanical travel thereof, as shown in FIG. 4A. In this position, the resistance between the displaceable contact 515 and the potentiometer terminal 516 is at a maximum and for practical purposes functions as an open circuit. Conversely, the resistance between the displaceable contact 515 and the potentiometer terminal 514 is at a minimum to thereby function as a short circuit, electrically connecting the filter capacitor terminal 524 to the terminal 604 of the pickup transducer sensor 718, 718' through its connection to the node 606. As the opposing filter capacitor terminal 522 is electrically connected to the terminal 602 of the pickup transducer sensor 718, 718', filter capacitor 520 is thereby coupled in parallel with the pickup transducer sensor 718, 718'. Accordingly, the low frequency component currents generated by pickup transducer sensors 718, 718' and 712, 712' flows from input terminal 502 to output terminal 506, returning to output terminal 508 and flowing to input terminal 504 to return to the series coupled pickup transducer sensors.

The high frequency component current generated by pickup transducer sensor 718, 718' flowing to input terminal 502 flows through capacitor 520 to pickup transducer sensor terminal 604 via input terminal 503 and node 606. Therefore, by this arrangement, the high frequency components generated by pickup transducer sensor 718, 718' are substantially suppressed (essentially shorted as a function of their frequency and the capacitance value). Thus, filter capacitor 520 of tone control system 500*b* defines a low pass filter for pickup transducer sensor 718, 718'. The high frequency components, however, generated by pickup transducer sensor 712, 712' which would otherwise be suppressed by the inductance of pickup transducer sensor 718, 718', flow from node 606 to input terminal 503 and through the filter capacitor 520 to output terminal 506; returning through output terminal 508 and input terminal 504 to the pickup transducer sensor terminal 610. For pickup transducer sensor 712, 712' filter capacitor 520 functions as a high frequency bypass capacitor, providing a circuit path for the high frequency signals to bypasses the reactance of pickup transducer sensor 718, 718'. With the displaceable contact 515 being at the first end of the mechanical travel of potentiometer 510, capacitor 520 provides suppression of high frequencies generated by the pickup transducer sensor 718, 718' closest to the bridge and the bypassing of the high frequencies of pickup transducer sensor 712, 712' closest to the neck. For a guitar with tone control system 500*b*, the displaceable contact at the first position hereto provides a sound typically preferred by musicians who play the "Blues" genre of music.

In FIG. 4B, the potentiometer 510 is set at an intermediate position of the mechanical travel of displaceable contact 515, which is preferably the midpoint thereof and may incorporate a mechanical detent 517 thereat to provide a tactile indication of that position to the musician playing the instrument. With the displaceable contact 515 at the midpoint of its mechanical travel and a linear taper of the resistive element 512, the resistance between the potentiometer terminal 518 and each of potentiometer terminals 514 and 516 are substantially equivalent and equal to one half the total resistance of resistance element 512. Therefore, here again, for practical purposes no current flows between terminal 518 and either of terminals 514 and 516 at this setting of the potentiometer. Accordingly, both filter capacitor 520 and filter capacitor 540 are isolated from both of the pickup transducer sensors 718, 718' and 712, 712' and there is no low pass filtering or high frequency bypass current path for either of the pickup transducer sensors through the filter capacitors 520 and 540. So again for the guitar 700 with the potentiometer 510 set at the intermediate position of the mechanical travel of displaceable contact 515, the sound produced will be of the type typically preferred by "Classic Rock" musicians.

At intermediate positions of the displaceable contact 515 between the position of the detent 517 and the first end of potentiometer 510, shown in FIG. 4A, the amount of resistance connected in series with capacitor 520, which together are connected in parallel with pickup transducer sensor 718, 718' and connected in the bypass path in series with the pickup transducer sensors 712, 712', is proportionately reduced or increased, as a function of the direction of displacement of displaceable contact 515. As discussed previously, that has the effect of blending in or blending out the effect of the capacitor 520 as the potentiometer is adjusted, effectively softening the transition between no filter and the full filtering effect of capacitor 520.

Referring to FIG. 4C, the displaceable contact 515 is set at the second end of the mechanical travel thereof. In that position, the resistance between the displaceable contact 515 and the potentiometer terminal 514 is at a maximum and for practical purposes functions as an open circuit. Whereas, the resistance between the displaceable contact 515 and the potentiometer terminal 516 is at a minimum to thereby function as a short circuit, electrically connecting the filter capacitor terminal 542 to the terminal 608 of the pickup transducer sensor 712, 712', through node 606 and input terminal 503 and the associated conductors. As the opposing filter capacitor terminal 544 is electrically connected to the opposing pickup transducer sensor terminal 610, filter capacitor 540 is thereby coupled in parallel with the pickup transducer sensor 712, 712'. Hence, when displaceable contact 515 is set at the second end of the mechanical travel, filter capacitor 540 forms a low pass filter for pickup transducer sensor 712, 712' and a high frequency bypass circuit path for pickup transducer sensor 718, 718', a complementary configuration to that which is obtained when the displaceable contact 515 is set at the first end of its mechanical travel. Again, tone Control system 500*b* differs from tone control system 500*a* in that it permits the filtering to be tailored to the positional relationships of the pickup transducer sensors through the use of filter capacitors of different values. The sound effect of this filter configuration hereto differs from that produced by the setting shown in FIGS. 4A and 3C by the finer tuning of the filtering that is applied. Nevertheless, for guitar 700, a sound typically preferred by musicians who play "Jazz" or "Rhythm" types of music.

The effect of adding resistance in series with the capacitor 540, at intermediate positions of the displaceable contact 515 between the position of the detent 517 and the second end position of potentiometer 510, shown in FIG. 4C, likewise has the effect of blending in or blending out the effect of the capacitor 540 as the potentiometer is adjusted. The potentiometer thereby advantageously, is effective to soften the transition between no filter and the full filtering effect provided by capacitor 540.

Figure 5A:
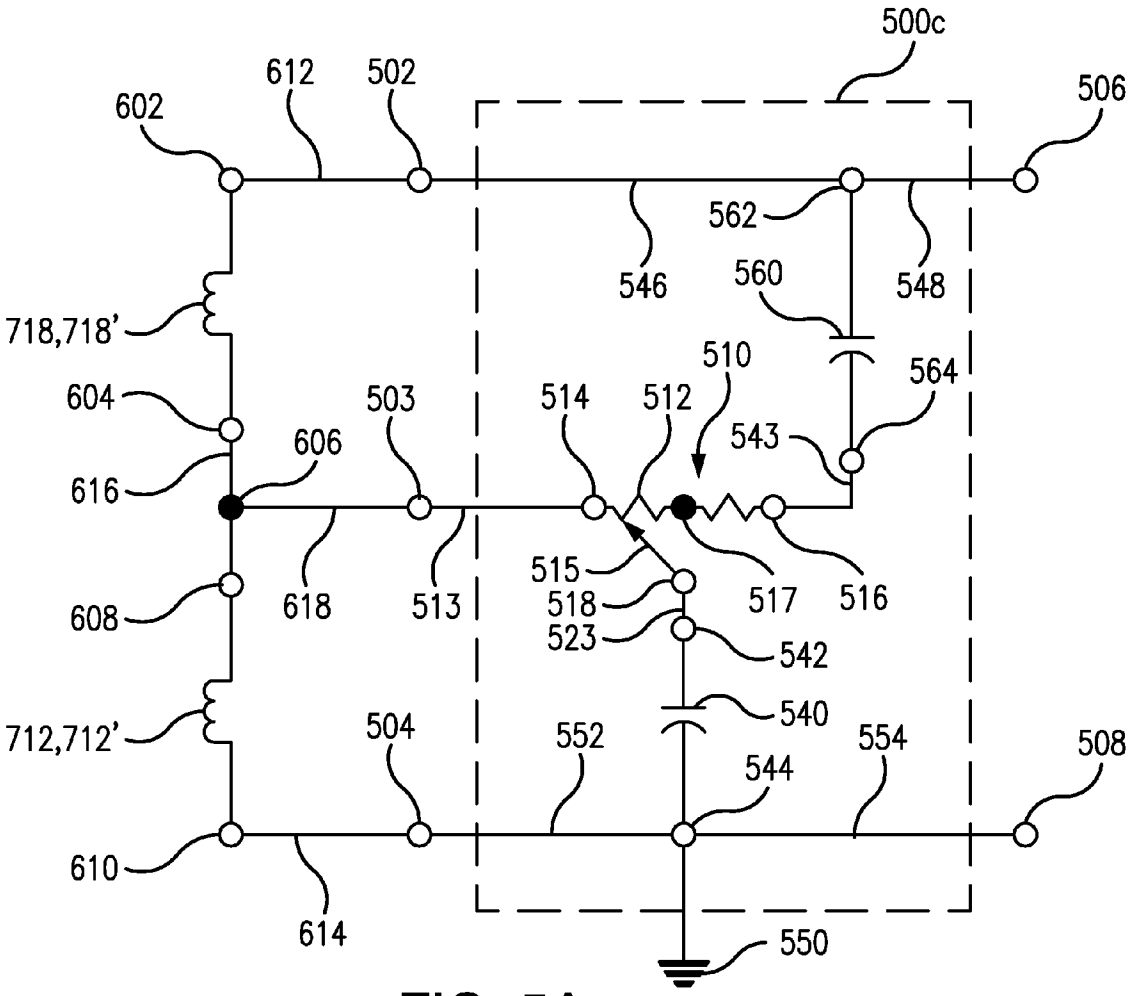
FIG. 5A is a schematic electrical diagram of a further arrangement of the tone control system adjusted for a low pass configuration applied to a second of the pickup transducers.
Figure 5B:
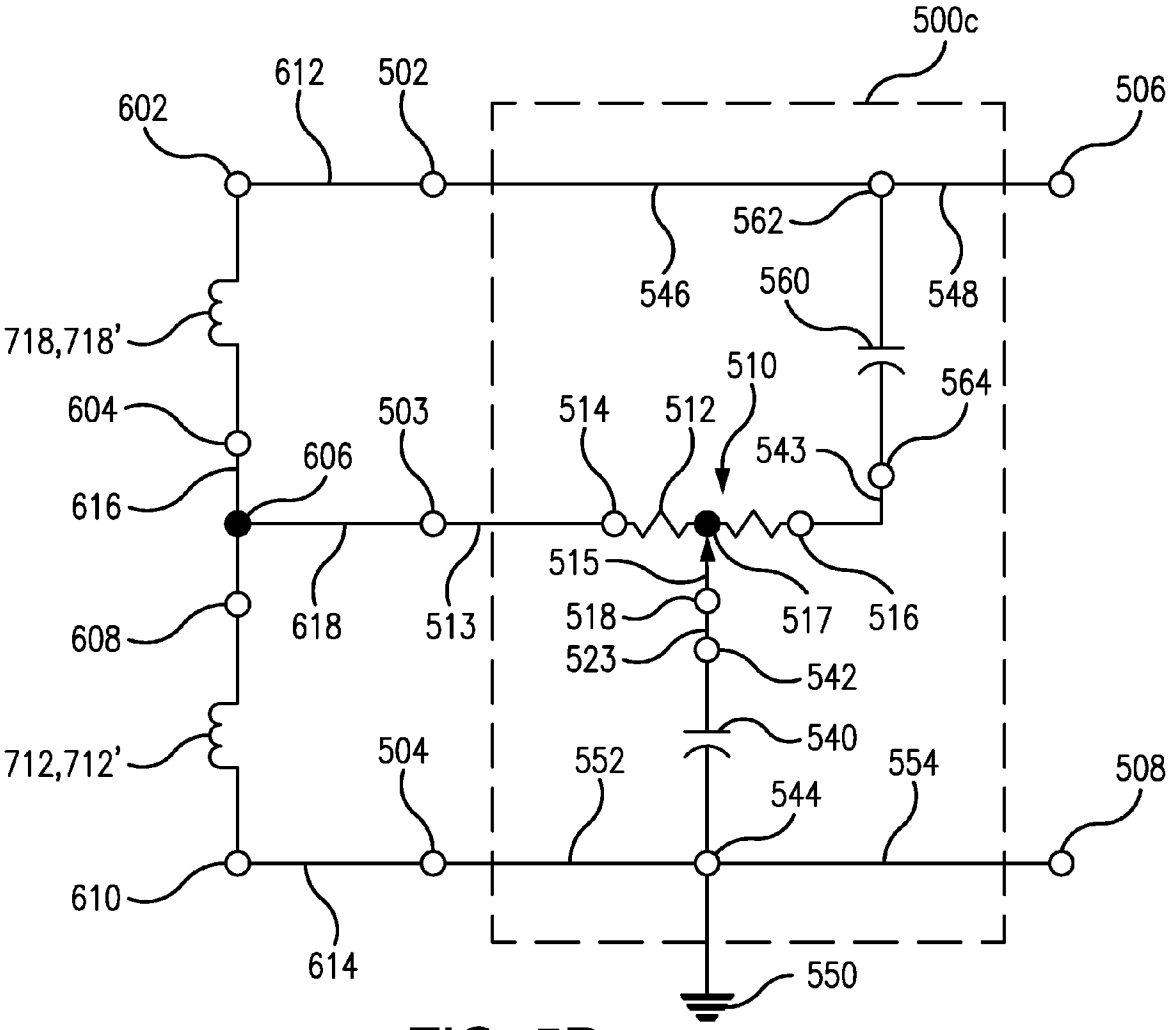
FIG. 5B is a schematic electrical diagram of the tone control system of FIG. 5A adjusted for an unfiltered configuration.
Figure 5C:
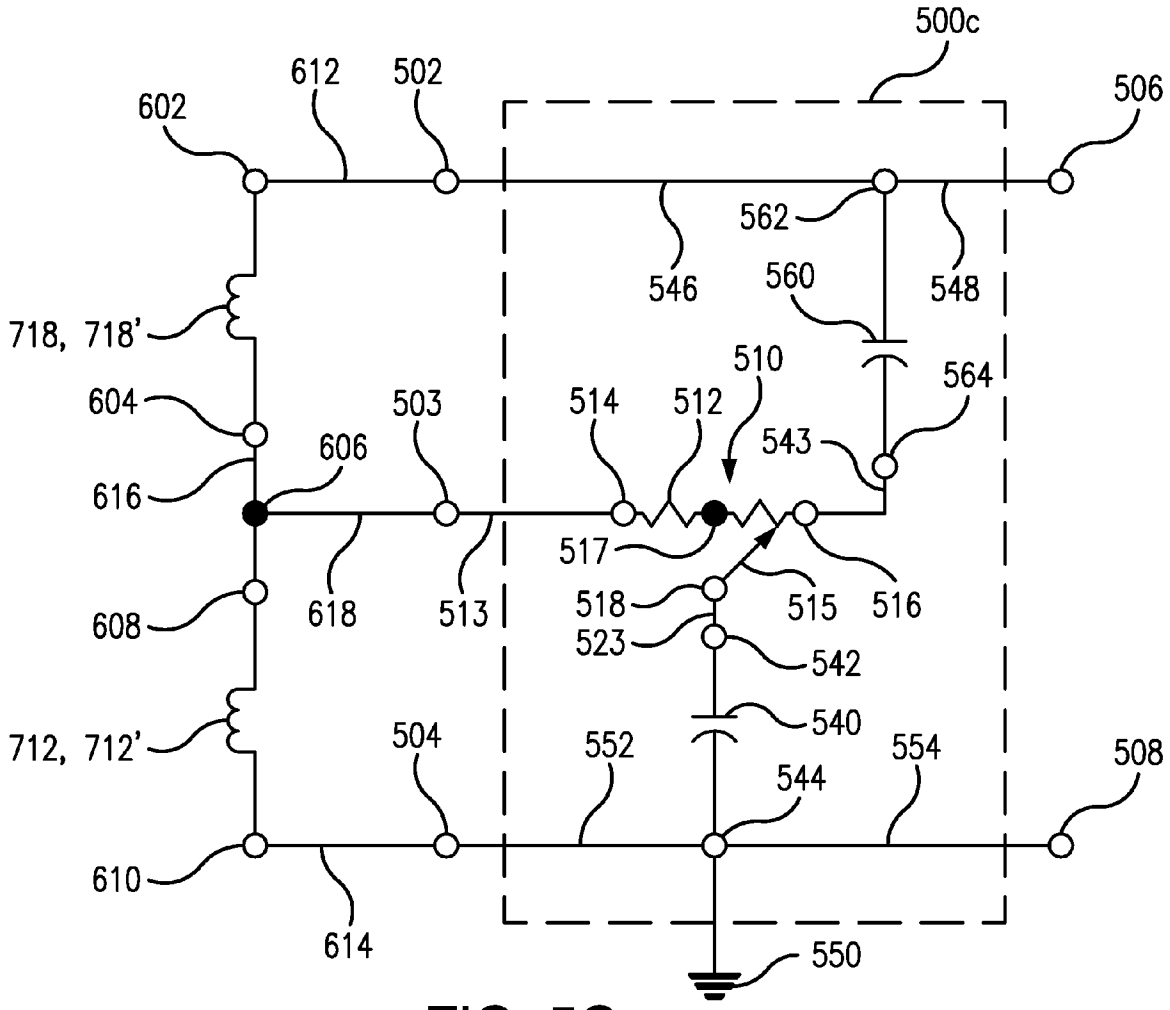
FIG. 5C is a schematic electrical diagram of the tone control system of FIG. 5A adjusted for a low pass configuration applied to the series combination of the first and second pickup transducers.

The schematic diagram of tone control system 500*c* is shown in each of FIGS. 5A, 5B and 5C, and illustrates the changes in the filtering configurations that are obtained at different respective settings thereof. Like tone control system 500*b*, tone control 500*c* provides for the selective coupling of a low pass filter to the pickup transducer sensor 712, 712' that functions as a high pass filter for pickup transducer sensor 718, 718' with the filter capacitor 540. Components having reference numerals in common with those components described with respect to tone control systems 500*a* and 500*b* are identical thereto. Accordingly, tone control system 500*c* includes a pair of filter capacitors 540 and 560 and a potentiometer 510 where capacitor 540 and potentiometer 510 are identical to that which was previously been described therefore. Tone control system 500*c* differs from the previously described tone control system 500*b* in that it provides for a selection of applying a low pass filter to the series combination of the pickup transducer sensors 718, 718' and 712, 712'.

Input terminal 503 is connected to the terminal 514 of potentiometer 510 by the conductor 513. Input terminal 502 is connected to both the output terminal 506 and the terminal 562 of capacitor 560 through respective conductors 546 and 548. Likewise, the input terminal 504 is connected to both the output terminal 508 and the terminal 544 of capacitor 540 through respective conductors 552 and 554. The terminal 544 of capacitor 540 is also connected to the ground reference potential 550. The opposing terminal 564 of capacitor 560 is connected to terminal 516 of potentiometer 510 by the conductor 543 and the opposing terminal 542 of capacitor 540 is connected to displaceable contact terminal 518 of potentiometer 510 by the conductor 523.

The functioning of tone control system 500*c* will now be described, beginning with the displaceable contact 515 being at a first end of the mechanical travel thereof, as shown in FIG. 5A. As will be seen, when the displaceable contact 515 is at the first end of its mechanical travel it functions like tone control system 500*b* with the displaceable contact at the send end of its mechanical travel. Hence, the capacitor 540 is connected in parallel with the pickup transducer sensor 712, 712' to form a low pass filter therefore and a high frequency bypass circuit path for pickup transducer sensor 718, 718'. For a guitar with tone control system 500*c*, the displaceable contact at the first position also provides a sound typically preferred by musicians who play "Jazz" types of music.

When the potentiometer 510 is set at the intermediate position of the mechanical travel of displaceable contact 515, where there may be an optional detent 517, as shown in FIG. 5B, both filter capacitor 540 and filter capacitor 560 are isolated from both of the pickup transducer sensors 718, 718' and 712, 712' and there is no low pass filter or high frequency bypass current paths for either of the pickup transducer sensors through the filter capacitors 520 and 540. For the guitar 700, the sound produced with the potentiometer 510 of tone control system 500*c* set at the intermediate position will be of the type typically preferred by "Classic Rock" musicians. Here again, the effect of adding resistance in series with the capacitor 540, at intermediate positions of the displaceable contact 515 between the position of the detent 517 and the first end position of potentiometer 510, shown in FIG. 5A, has the effect of blending in or blending out, as a function of the direction of displacement of displaceable contact 515, the effect of the capacitor 540 as the potentiometer is adjusted to soften the transition between no filter and the full filtering effect provided by capacitor 540.

Then, when the displaceable contact is set at the second end of the mechanical travel, as shown in FIG. 5C, there is essentially an open circuit between the displaceable contact 518 and the node 606. Accordingly neither filter capacitor can be paralleled with just a single one of the pickup transducer sensors 718, 718' and 712, 712'. The displaceable contact 515, however, at the second end of the mechanical travel, is connected directly to the terminal 516 of potentiometer 510. That setting of potentiometer 510 places filter capacitor 540 in series with filter capacitor 560. As is well known, the total capacitance of series coupled capacitors is less than the value of any of the capacitors. For two capacitors in series the total capacitance $C_T$ has a value determined by the equation: $C_T=(C_1 \times C_2)/(C_1+C_2)$. When the capacitances of the two capacitors ($C_1$, $C_2$) are equal, the total equivalent capacitance value ($C_T$) of the series combination is one half the value of either of the individual capacitors. Thus, the capacitance of Capacitor 560 is chosen to give a desired equivalent capacitance value for the series combination of filter capacitors 540 and 560, which will be less than the capacitance of capacitor 540. In one working embodiment filter capacitor 560 had a capacitance value within the range of 27 nf to 100 nf and preferably within the range of 33 nf to 68 nf. The series combination of filter capacitors 540 and 560 being coupled in parallel with the series combination of pickup transducer sensors 718, 718' and 712, 712' forms a low pass filter therefore to suppress the high frequency components of the signals generated by the pickup transducer sensors 718, 718' and 712, 712'.

At intermediate positions of the displaceable contact 515 between the position of the detent 517 and the second end position of potentiometer 510, shown in FIG. 5C, has the effect of blending in, or blending out, the effect of the series combination of filter capacitors 540 and 560 as the potentiometer is adjusted to thereby soften the transition between no filter and the full filtering effect provided by low pass filter formed by filter capacitors 540 and 560. The effect of that low pass filter being coupled to the series combination of pickup transducer sensors 718, 718' and 712, 712' in guitar 700 is like that of a classic guitar tone control.

Figure 6A:
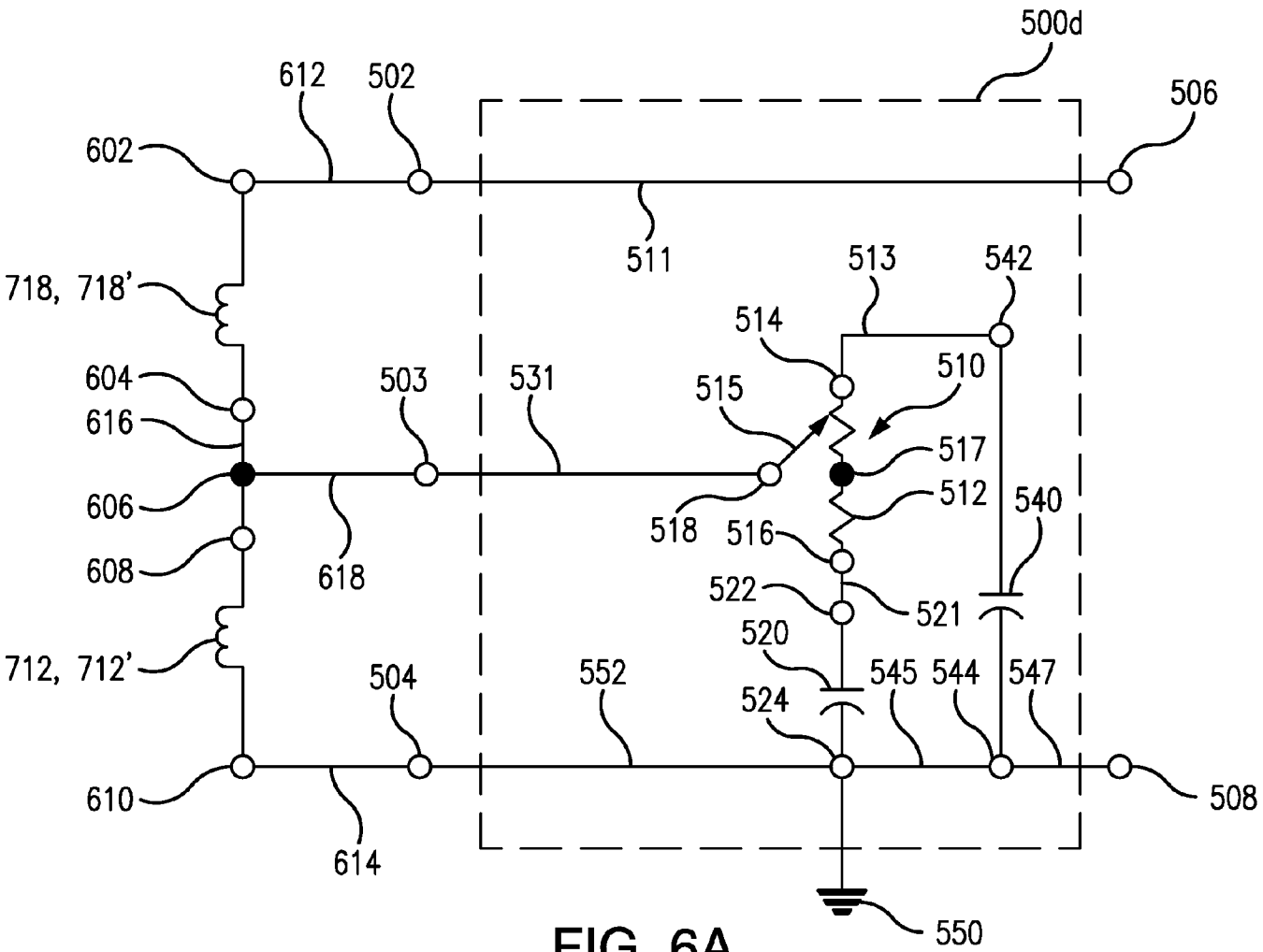
FIG. 6A is a schematic electrical diagram of yet another arrangement of the tone control system adjusted for a low pass configuration applied to a particular one of the pickup transducers.
Figure 6B:
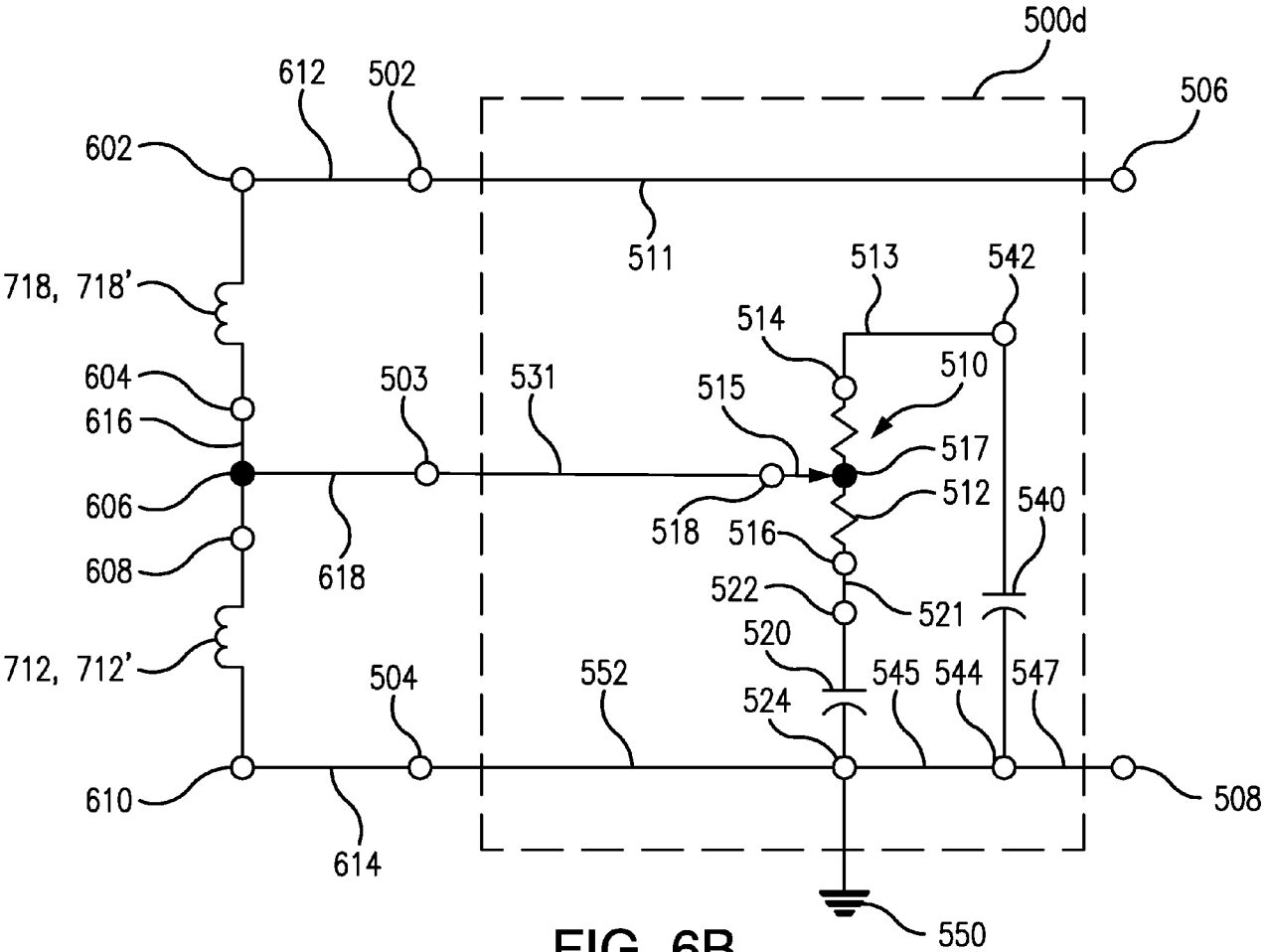
FIG. 6B is a schematic electrical diagram of the tone control system of FIG. 6A adjusted for an unfiltered configuration.
Figure 6C:
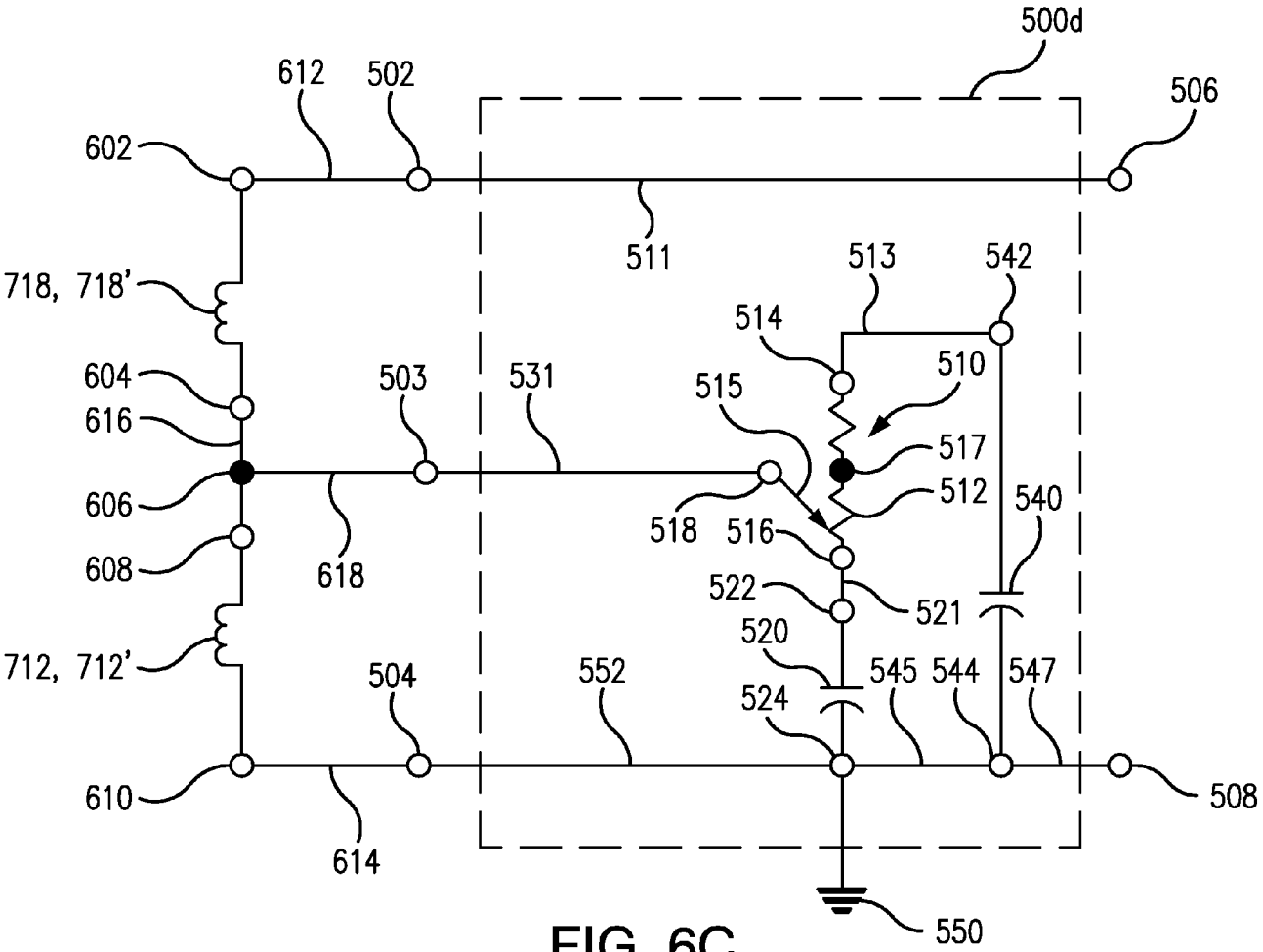
FIG. 6C is a schematic electrical diagram of the tone control system of FIG. 6A adjusted for a different low pass configuration applied to the particular one of the pickup transducers.

The schematic diagram for tone control system 500*d* is shown at different settings in FIGS. 6A, 6B and 6C. Tone control system 500*d* provides for the selective coupling of either of a pair of low pass filter capacitors to the pickup transducer sensor 712, 712' that also function as a high frequency bypass filter for the pickup transducer sensor 718, 718'. As will be discussed in following paragraphs, tone control system 500*d* is easily modified to provide selective coupling of either of a pair of low pass filter capacitors to the pickup transducer sensor 718, 718' that also function as a high frequency bypass circuit path for the pickup transducer sensor 712, 712'. As previously mentioned, components having reference numerals in common with those components described with respect to tone control systems 500*a*, 500*b* and 500*c* are identical thereto.

Input terminal 503 is connected to the displaceable contact terminal 518 of potentiometer 510 by the conductor 531. Input terminal 502 is connected to output terminal 506 by the conductor 511. The input terminal 504 is connected to output terminal 508 and both the terminal 524 of capacitor 520 and terminal 544 of capacitor 540 through respective conductors 552, 545 and 547. The terminal 524 of capacitor 540 is also connected to the ground reference potential 550. The opposing terminal 522 of capacitor 520 is connected to terminal 516 of potentiometer 510 by the conductor 521 and the opposing terminal 542 of capacitor 540 is connected to terminal 514 of potentiometer 510 by the conductor 513.

The functioning of tone control system 500*d* will now be described, beginning with the displaceable contact 515 being at a first end of the mechanical travel thereof, as shown in FIG. 6A. In this position, there is essentially an open circuit between the displaceable contact 515 and the potentiometer terminal 516 and a short circuit between the displaceable contact 515 and the potentiometer terminal 514, as previously discussed, to electrically connect the filter capacitor terminal 542 to the terminal 608 of the pickup transducer sensor 712, 712' through its connection to the node 606. As the opposing filter capacitor terminal 544 is electrically connected to the terminal 610 of the pickup transducer sensor 712, 712', filter capacitor 540 is thereby coupled in parallel with the pickup transducer sensor 712, 712'. Accordingly, capacitor 540 functions as a low pass filter for pickup transducer sensor 712, 712', suppressing high frequency components of the signals generated thereby. Since capacitor 540 function as a series current path for high frequency signal components generated by pickup transducer sensor 718, 718', it defines a high frequency bypass capacitor therefore.

In FIG. 6B, the displaceable contact 515 is set at the intermediate position of its mechanical travel, which is preferably the midpoint thereof and may incorporate a mechanical detent 517 thereat to provide a tactile indication of that position to the musician playing the instrument. As should now be well understood, both filter capacitor 540 and filter capacitor 520 are isolated from connection to the pickup transducer sensor 712, 712' and there is no high frequency bypass current path for the pickup transducer sensor 718, 718' through either filter capacitor 540 or 520. Therefore, the guitar 700 produces a sound typically preferred by "Classic Rock" musicians with the potentiometer 510 of tone control system 500*d* set at the intermediate position, just as is produced with any of tone control systems 500*a*, 500*b* or 500*c*. Hereto, the effect of adding resistance in series with the capacitor 540, at intermediate positions of the displaceable contact 515 between the position of the detent 517 and the first end position of potentiometer 510, shown in FIG. 6A, has the effect of blending in, or blending out, the effect of the capacitor 540 as the potentiometer is adjusted to soften the transition between no filter and the full filtering effect provided by capacitor 540.

Referring to FIG. 6C, the displaceable contact 515 is set at the second end of the mechanical travel thereof. In that position, as should now also be well understood, the resistance between the displaceable contact 515 and the potentiometer terminal 514 is at a maximum and for practical purposes functions as an open circuit. The resistance between the displaceable contact 515 and the potentiometer terminal 516, on the other hand, is at a minimum to electrically connect the filter capacitor terminal 522 to the terminal 608 of the pickup transducer sensor 712, 712', through node 606 and input terminal 503 and the associated conductors. As the opposing filter capacitor terminal 524 is electrically connected to the opposing pickup transducer sensor terminal 610 via the input terminal 504 and the associated conductors, filter capacitor 520 is thereby coupled in parallel with the pickup transducer sensor 712, 712'. Hence, when displaceable contact 515 is set at the second end of the mechanical travel, filter capacitor 520 forms the low pass filter for pickup transducer sensor 712, 712' and the high frequency bypass circuit path for pickup transducer sensor 718, 718'. Tone Control system 500*d* therefore permits the low pass filtering to be tailored through the selection of low pass filters of different pass frequencies, the pass frequency being a function of the capacitance value of the paralleled filter capacitor 540 or 520. Due to the different pass frequency achieved with filter capacitor 520 the sound effect of this filter configuration differs from that produced by the setting shown in FIG. 6A. Filter capacitor 520, having a smaller capacitance value than filter capacitor 540 will have a different pass band, suppressing different frequency components of the signal generated pickup transducer sensor 712, 712' less. For the guitar 700 with tone control system 500*d*, setting the potentiometer 510 at the first or second ends of the mechanical travel of displaceable contact 515 produces two different distinctive sounds preferred by musicians who play "Rhythm" genre of music.

The effect of adding resistance in series with the capacitor 520, at intermediate positions of the displaceable contact 515 between the position of the detent 517 and the second end position of potentiometer 510, shown in FIG. 6C, likewise has the effect of blending in or blending out the effect of the capacitor 520 as the potentiometer is adjusted. The potentiometer accordingly, is effective to soften the transition between no filter and the full filtering effect provided by capacitor 520.

Tone control system 500*d* may be easily modified to provide selective coupling of either of a filter capacitor 540 or filter capacitor 520 as a low pass filter for the pickup transducer sensor 718, 718', being connected in parallel therewith, and function as a high frequency bypass path for the pickup transducer sensor 712, 712'. That configuration is achieved by changing the connections of the capacitor terminals 524 and 544 from connection to both input terminal 504 and output terminal 508 to connection to both input terminal 502 and output terminal 506. That change provides for selecting either of capacitors 520 or 540 for coupling in parallel to pickup transducer sensor 718, 718' or at the detent 517, isolation of both filter capacitors. With this modification, the guitar 700 provides two different distinctive sounds that is typically preferred by musicians who play the "Blues" genre of music, when either of filter capacitors 520 or 540 are selected with the potentiometer 510.

Figure 7:
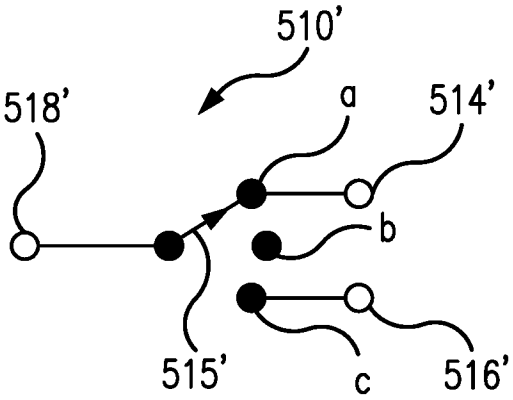
FIG. 7 is schematic electrical diagram of a switch the can be substituted for the potentiometer in the tone control systems of FIGS. 3A-6C.

Turning now to FIG. 7, there is shown a schematic representation of a switch 510' that may be employed in the tone control system 500*a*, 500*b*, 500*c*, 500*d*. Switch 510' may be implemented by any of a wide variety of types of three position switches, for example three position rotary switches, three position push-pull switches, single pole, double through, center off toggle and slide switches and the like. In the circuit configuration of each of tone control systems 500*a*, 500*b*, 500*c* and 500*d*, switch 510' may be interchanged with the potentiometer 510. Thus, in place of a connection to the potentiometer terminal 518, switch terminal 518' is used. Switch terminal 514' is connected in place of potentiometer terminal 514 and switch terminal 516' is connected in place of potentiometer terminal 516. Thus, when the displaceable switch contact 515' is connected to the switch contact a, such corresponds to the potentiometer displaceable contact being at the first end of its mechanical travel, and when connected to the switch contact c, such corresponds to the potentiometer displaceable contact being at the second end of its mechanical travel. Lastly, when the displaceable switch contact 515' is connected to the switch contact b, such corresponds to the potentiometer displaceable contact being at the intermediate position of its mechanical travel. However, using switch 510' to select the filtering configuration connected to the series coupled pickup transducer sensors 712, 712' and 718, 718' removes the advantageous blending effect obtained using potentiometer 510 for that selection.

The descriptions above are intended to illustrate possible implementations of the present invention and are not restrictive. While this invention has been described in connection with specific forms and embodiments thereof, it will be appreciated that various modifications other than those discussed above may be resorted to without departing from the spirit or scope of the invention. Such variations, modifications, and alternatives will become apparent to the skilled artisan upon review of the disclosure. For example, functionally equivalent elements may be substituted for those specifically shown and described, and certain features may be used independently of other features, and in certain cases, particular locations of elements may be reversed or interposed, all without departing from the spirit or scope of the invention as defined in the appended Claims. The scope of the invention should therefore be determined with reference to the description above, the appended claims and drawings, along with their full range of equivalents.

What is being claimed is:

1. A tone control system for string instruments comprising:

a pair of pickup transducer sensors disposed on a string instrument for generating voltages responsive to vibration of at least one string of the string instrument, said pair of pickup transducer sensors being coupled in series relationship and having a node at a junction between said pair of pickup transducer sensors;

a capacitive filter; and a tone selection circuit coupled to each of said pair of pickup transducer sensors and said node, and said capacitive filter, said tone selection circuit includes a single switching element for selectively connecting a) a first of said pair of pickup transducer sensors in parallel with said capacitive filter as a low pass filter therefore and as a high frequency bypass circuit for the second of said pair of pickup transducer sensors, or b) the second of said pair of pickup transducer sensors in parallel with said capacitive filter as said low pass filter therefore and as a high frequency bypass circuit for the first of said pair of pickup transducer sensors, or c) neither of said pair of pickup transducer sensors to said capacitive filter.

2. The tone control system for string instruments as recited in claim 1, where said capacitive filter includes at least one capacitor.

3. The tone control system for string instruments as recited in claim 1, where said capacitive filter includes a pair of capacitors.

4. The tone control system for string instruments as recited in claim 1, where said single switching element is a potentiometer having a resistive element coupled between first and second terminals thereof and a displaceable contact connecting to said resistive element and a third terminal, at least one of said first, second and third terminals being coupled to said capacitive filter.

5. The tone control system for string instruments as recited in claim 1, where said single switching element is a switch having first and second switched terminals and a movable contact coupled to a third terminal thereof, at least one of said first switched terminal, second switched terminal and third terminal being coupled to said capacitive filter.

6. The tone control system for string instruments as recited in claim 3, where said tone selection circuit connects a) said first of said pair of pickup transducer sensors in parallel with a first of said pair of capacitors as a low pass filter therefore and a high frequency bypass circuit for the second of said pair of pickup transducer sensors, or b) the second of said pair of pickup transducer sensors in parallel with a second of said pair of capacitors as a low pass filter therefore and a high frequency bypass circuit for the first of said pair of pickup transducer sensors, or c) neither of said pair of pickup transducer sensors in parallel with either of said pair of capacitors.

7. The tone control system for string instruments as recited in claim 6, where said single switching element is a potentiometer having a resistive element coupled between first and second terminals thereof and a displaceable contact connecting to said resistive element and a third terminal, said first and second terminals being respectively coupled a first terminal of a corresponding one of said pair of capacitors, said third terminal being coupled to said node.

8. The tone control system for string instruments as recited in claim 7, where each of said pair of capacitors has a second terminal respectively coupled to a corresponding one of said pair of pickup transducer sensors.

9. The tone control system for string instruments as recited in claim 6, where said single switching element is a switch having first and second switched terminals and a movable contact coupled to a third terminal thereof, said third terminal being coupled to said node, each of said first and second switched terminals being respectively coupled to a corresponding one of said pair of capacitors.

10. A tone control system for string instruments comprising:

a pair of pickup transducer sensors disposed on a string instrument for generating voltages responsive to vibration of at least one string of the string instrument, said pair of pickup transducer sensors being coupled in series relationship and having a node at a junction between said pair of pickup transducer sensors;

a capacitive filter including a pair of capacitors; and a tone selection circuit coupled to said node and one terminal of each of said pair of capacitors, said tone selection circuit includes a single switching element for selectively connecting a) a first of said pair of pickup transducer sensors in parallel with a first of said pair of capacitors as a low pass filter therefore and as a high frequency bypass circuit for the second of said pair of pickup transducer sensors, or b) the series combination of said pair of pickup transducer sensors in parallel with a series combination of said pair of capacitors as a low pass filter therefore, or c) neither of said pair of pickup transducer sensors to either of said pair of capacitors.

11. The tone control system for string instruments as recited in claim 10, where each of said pair of capacitors has a second terminal coupled to one of said pair of pickup transducer sensors.

12. The tone control system for string instruments as recited in claim 10, where said single switching element is a potentiometer having a resistive element coupled between first and second terminals thereof and a displaceable contact connecting to said resistive element and a third terminal, said second and third terminals being respectively coupled to said one terminal of a corresponding one of said pair of capacitors, said first terminal being coupled to said node.

13. The tone control system for string instruments as recited in claim 10, where said single switching element is a switch having first and second switched terminals and a movable contact coupled to a third terminal thereof, said third terminal and said second switched terminal being respectively coupled to said one terminal of a corresponding one of said pair of capacitors, said first switched terminal being coupled to said node.

14. A tone control system for a string instrument comprising:

a pair of pickup transducer sensors disposed on a string instrument for generating voltages responsive to vibration of at least one string of the string instrument, said pair of pickup transducer sensors being coupled in series relationship and having a node at a junction between said pair of pickup transducer sensors;

a capacitive filter including a pair of capacitors having different values; and a tone selection circuit coupled to said node and one terminal of each of said pair of capacitors, said tone selection circuit includes a single switching element for selectively connecting a) a first of said pair of capacitors in parallel with one of said pair of pickup transducer sensors as a first low pass filter therefore and as a high frequency bypass circuit for the other of said pair of pickup transducer sensors, or b) the other of said pair of pickup capacitors in parallel with said one of said pair of pickup transducer sensors as a second low pass filter therefore, said second low pass filter being different than said first low pass filter, or c) neither of said pair of capacitors to either of said pair of pickup transducer sensors.

15. The tone control system for string instruments as recited in claim 14, where said single switching element is a potentiometer having a resistive element coupled between first and second terminals thereof and a displaceable contact connecting to said resistive element and a third terminal, said first and second terminals being respectively coupled to said one terminal of a corresponding one of said pair of capacitors, said third terminal being coupled to said node.

16. The tone control system for string instruments as recited in claim 15, where each of said pair of capacitors has a second terminal coupled to said one of said pair of pickup transducer sensors.

17. The tone control system for string instruments as recited in claim 15, where said single switching element is a switch having first and second switched terminals and a movable contact coupled to a third terminal thereof, said first and second switched terminals being respectively coupled to said one terminal of a corresponding one of said pair of capacitors, said third terminal being coupled to said node.

18. The tone control system for string instruments as recited in claim 17, where each of said pair of capacitors has a second terminal coupled to said one of said pair of pickup transducer sensors.

* * * * *